US010146156B2

(12) United States Patent
Sato

(10) Patent No.: US 10,146,156 B2
(45) Date of Patent: Dec. 4, 2018

(54) IMAGE FORMING APPARATUS AND TONER CARTRIDGE

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/881,138

(22) Filed: Jan. 26, 2018

(65) Prior Publication Data

US 2018/0149997 A1 May 31, 2018

Related U.S. Application Data

(63) Continuation of application No. 15/286,766, filed on Oct. 6, 2016, now Pat. No. 9,904,211.

(30) Foreign Application Priority Data

Oct. 7, 2015 (JP) ..... 2015-199113

(51) Int. Cl.
*G03G 15/00* (2006.01)
*G03G 15/08* (2006.01)
*G03G 21/18* (2006.01)

(52) U.S. Cl.
CPC ..... *G03G 15/0886* (2013.01); *G03G 15/0865* (2013.01); *G03G 21/1814* (2013.01); *G03G 21/1832* (2013.01)

(58) Field of Classification Search
CPC ..... G03G 15/0832; G03G 15/0865; G03G 15/0877; G03G 15/0886; G03G 15/0896; G03G 21/1676; G03G 21/1814; G03G 21/1832; G03G 2215/0692;
(Continued)

(56) References Cited

U.S. PATENT DOCUMENTS 5,835,822 A 11/1998 Nagasaki et al.
6,137,972 A 10/2000 Playfair et al.
6,792,230 B2 9/2004 Saito et al.
(Continued)

FOREIGN PATENT DOCUMENTS

JP 2009-151280 A 7/2009
JP 2009-193007 A 8/2009
JP 2009-237252 A 10/2009

*Primary Examiner* — Sophia S Chen
(74) *Attorney, Agent, or Firm* — Banner & Witcoff, Ltd.

(57) ABSTRACT

An image forming apparatus includes a photosensitive drum, a developing device including a developing roller and a developing frame including a toner receiving port, and a toner cartridge including a toner accommodation part and a conveyance device configured to convey toner from the toner accommodation part toward the developing device. The conveyance device includes a coupling tube and a shutter. The coupling tube includes a toner supply port faceable the toner receiving port, is coupleable to the developing device and is movable with respect to the toner accommodation part at a state where the coupling tube is coupled to the developing device and the toner supply port faces the toner receiving port. The shutter is movable between an opening position at which the toner supply port is opened with the coupling tube being coupled to the developing device and a closed position.

19 Claims, 14 Drawing Sheets

(58) Field of Classification Search
CPC ..... G03G 2221/163; G03G 2221/1684; G03G 2221/1853
See application file for complete search history.

(56) References Cited

U.S. PATENT DOCUMENTS

| | | | | |
|---|---|---|---|---|
| 7,412,189 | B2 | 8/2008 | Jeong | |
| 8,073,357 | B2 | 12/2011 | Sakuma | |
| 8,180,260 | B2 | 5/2012 | Yanagi | |
| 8,185,022 | B2 | 5/2012 | Sato | |
| 8,565,650 | B2 | 10/2013 | Sato | |
| 8,897,679 | B2 | 11/2014 | Kawashima | |
| 2009/0052940 | A1 | 2/2009 | Mizuno et al. | |
| 2009/0142105 | A1 | 6/2009 | Yanagi | |
| 2009/0208245 | A1 | 8/2009 | Sato | |
| 2009/0214257 | A1 | 8/2009 | Kweon et al. | |
| 2009/0245854 | A1 | 10/2009 | Sakuma | |
| 2012/0009514 | A1 | 1/2012 | Nagayama et al. | |
| 2012/0213556 | A1 | 8/2012 | Sato | |
| 2015/0220022 | A1* | 8/2015 | Sakuma ..... | G03G 15/0877 399/263 |
| 2015/0261173 | A1 | 9/2015 | Sato | |

* cited by examiner

IMAGE FORMING APPARATUS AND TONER CARTRIDGE

CROSS-REFERENCE TO RELATED APPLICATION

This application is a continuation of U.S. patent application Ser. No. 15/286,766 filed Oct. 6, 2016 which claims priority from Japanese Patent Application No. 2015-199113 filed on Oct. 7, 2015, the entire subject-matter of which are incorporated herein by reference.

TECHNICAL FIELD

The disclosure relates to an electrophotographic image forming apparatus and a toner cartridge to be mounted to the image forming apparatus.

BACKGROUND

As an electrophotographic image forming apparatus, there has been known an image forming apparatus including a photosensitive drum, a developing device having a developing roller, and a toner cartridge configured to accommodate therein toner.

As the image forming apparatus, there has been known an image forming apparatus configured to supply toner in the toner cartridge to the developing device with a supply port of the toner cartridge and a supplied port of the developing device facing each other.

In the image forming apparatus, the developing device is configured to swing with respect to the photosensitive drum.

SUMMARY

The developing device is configured to swing with respect to not only the photosensitive drum but also the toner cartridge. For this reason, a position of the supplied port of the developing device may deviate with respect to the supply port of the toner cartridge, which may cause toner leakage.

Also, it is considered to swing the toner cartridge together with the developing device so as to prevent the positions the supply port of the toner cartridge and the supplied port of the developing device from deviating with respect to each other. However, when a toner capacity of the toner cartridge is large, it is difficult to swing the toner cartridge together with the developing device.

Illustrative aspects of the disclosure provide an image forming apparatus capable of suppressing toner leakage between a toner cartridge and a developing device even when the toner cartridge and the developing device moves relative to each other, and a toner cartridge.

According to one illustrative aspect, there may be provided an image forming apparatus comprising: a photosensitive drum; a developing device comprising a developing roller and a developing frame, the developing frame comprising a toner receiving port; and a toner cartridge, wherein the toner cartridge comprises: a toner accommodation part; and a conveyance device configured to convey toner from the toner accommodation part toward the developing device, wherein the conveyance device comprises: a coupling tube comprising a toner supply port and configured to be coupled to the developing device, the toner supply port being configured to face the toner receiving port with the coupling tube being coupled to the developing device, the coupling tube being movable with respect to the tonner accommodation part at a state where the coupling tube is coupled to the developing device and the toner supply port faces the toner receiving port; and a shutter configured to move between an opening position and a closed position, the opening position being a position at which the toner supply port is opened with the coupling tube being coupled to the developing device, the closed position being a position at which the toner supply port is closed with the coupling of the coupling tube to the developing device being released.

According to another illustrative aspect, there may be provided a toner cartridge configured to be mounted and removed to and from an image forming apparatus, the image forming apparatus comprising a photosensitive drum and a developing device, the developing device comprising a a toner receiving port, the toner cartridge comprising: a toner accommodation part; and a coupling tube extending from the toner accommodation part, the coupling tube comprising a toner supply port and configured to be coupled to the developing device, the toner supply port being configured to face the toner receiving port with the coupling tube being coupled to the developing device.

DETAILED DESCRIPTION

Figure 1:
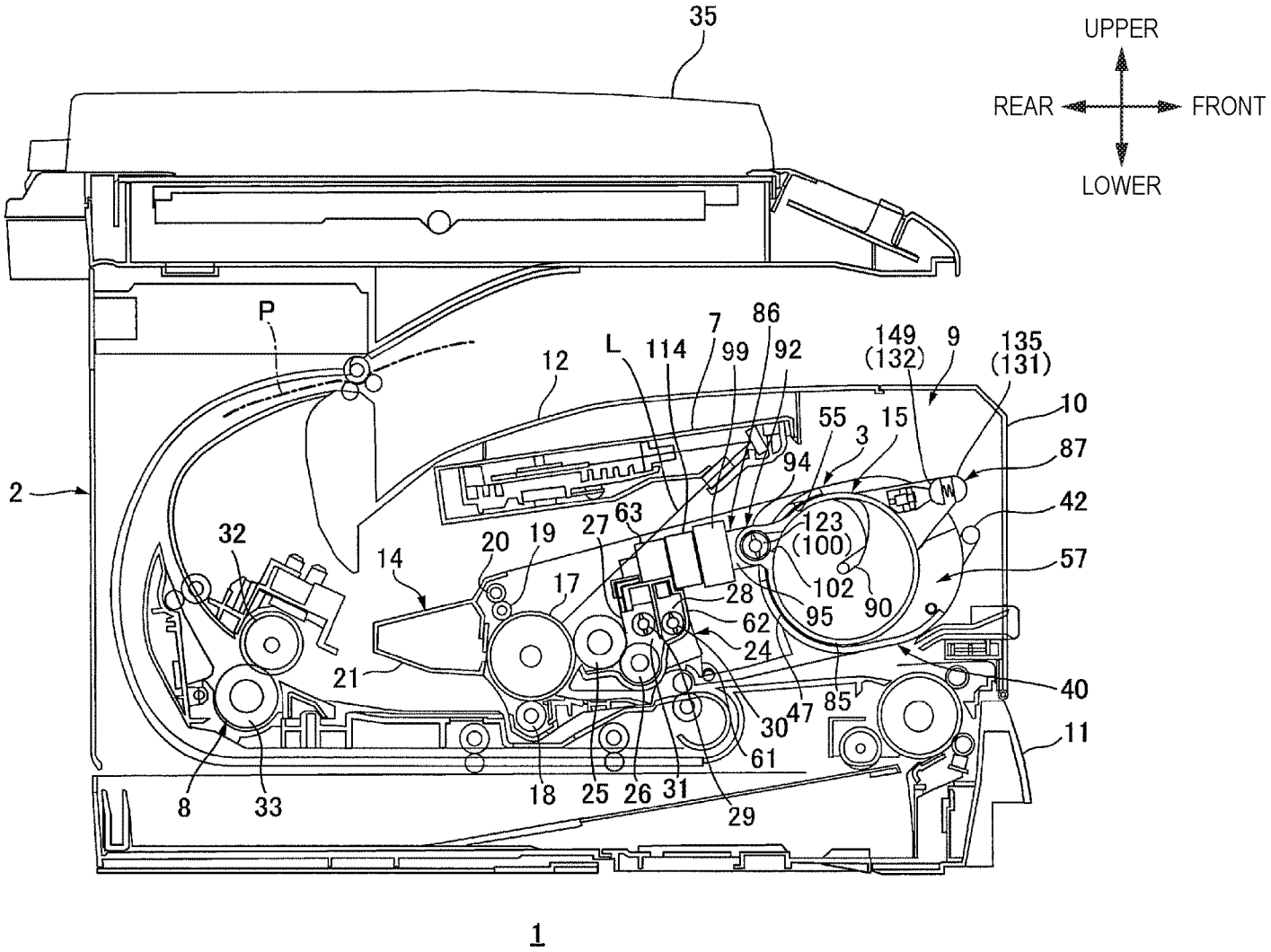
FIG. 1 is a central sectional view depicting a first illustrative embodiment of an image forming apparatus of the disclosure.

Hereinafter, an image forming apparatus 1 will be described. In below descriptions, directions are described on the basis of direction arrows shown in the drawings.

1. Outline of Printer

As shown in FIG. 1, the image forming apparatus 1 is an electrophotographic monochrome printer. The image forming apparatus 1 has an apparatus main body 2 having an opening 9, a process cartridge 3, a scanner unit 7, a fixing unit 8 and a reading unit 35.

The apparatus main body 2 has a substantial box shape. The apparatus main body 2 has a front cover 10, a sheet feeding tray 11 and a sheet discharging tray 12.

The opening 9 is positioned at a front end portion of the apparatus main body 2. The opening 9 is provided to communicate an interior and an exterior of the apparatus main body 2 each other. The opening 9 is configured to permit the process cartridge 3 to pass therethrough.

The front cover 10 is positioned at the front end portion of the apparatus main body. The front cover 10 has a substantial plate shape extending in an upper-lower direction. The front cover 10 is supported to the front end portion of the apparatus main body 2 to swing about a lower end portion of the front cover 10, which is a support point. The front cover 10 can swing between a closed position at which the opening 9 is to be closed and an opening position (refer to FIGS. 9 and 10) at which the opening 9 is to be opened.

The sheet feeding tray 11 is positioned at a lower end portion of the apparatus main body 2. The sheet feeding tray 11 is a tray capable of accommodating therein sheets P.

The sheet discharging tray 12 is positioned at a substantial center in a front-rear direction of an upper surface of the apparatus main body 2. The sheet discharging tray 12 is recessed downward from the upper surface of the apparatus main body 2 so that the sheet P is to be placed thereon.

The process cartridge 3 is configured to be detachably mounted to the apparatus main body 2. The process cartridge 3 is positioned at a substantial center in the upper-lower direction in the apparatus main body 2. The process cartridge 3 is positioned above the sheet feeding tray 11 and below the sheet discharging tray 12. The process cartridge 3 has a drum unit (which may also be called as a drum cartridge) 14 and a toner cartridge 15.

The drum unit 14 has a photosensitive drum 17, a transfer roller 18, a charging roller 19, a charging cleaning roller 20, a drum cleaning unit 21 and a developing device 24. The charging cleaning roller 20 is configured to remove attachments such as remaining toner and paper dust attached to a surface of the charging roller 19. The drum cleaning unit 21 is configured to collect the attachments attached to the photosensitive drum 17 and to reserve the attachments.

The photosensitive drum 17 is positioned at a rear end portion of the drum unit 14. The photosensitive drum 17 has a substantial cylinder shape extending in a left-right direction.

The transfer roller 18 is positioned below the photosensitive drum 17. The transfer roller 18 is configured to be in contact with the photosensitive drum 17.

The charging roller 19 is positioned at a rear-upper side of the photosensitive drum 17. The charging roller 19 is configured to be in contact with the photosensitive drum 17. The charging roller 19 is configured to charge a surface of the photosensitive drum 17.

The developing device 24 is positioned in front of the photosensitive drum 17. The developing device 24 has a developing roller 25, a supply roller 26, and a layer thickness regulation blade 27.

The developing roller 25 is positioned at a rear end portion of the developing device 24. The developing roller 25 is configured to be in contact with a front circumferential surface of the photosensitive drum 17. The developing roller 25 is rotatably supported to the developing device 24. That is, the developing roller 25 and the photosensitive drum 17 are aligned side by side in the front-rear direction.

The supply roller 26 is positioned at a front-lower side of the developing roller 25. The supply roller 26 is configured to be in contact with a front-lower surface of the developing roller 25. The supply roller 26 is rotatably supported to the developing device 24.

The layer thickness regulation blade 27 is positioned at a front-upper side of the developing roller 25. A lower end portion of the layer thickness regulation blade 27 is configured to be in contact with a front surface of the developing roller 25.

The toner cartridge 15 is configured to be detachably mounted to the drum unit 14. The toner cartridge 15 is positioned in front of the developing device 24. The toner cartridge 15 can accommodate therein toner. Although described in detail later, the toner cartridge 15 can supply the toner therein to the developing device 24.

The scanner unit 7 is positioned above the process cartridge 3. The scanner unit 7 can emit a laser beam L based on image data toward the photosensitive drum 17.

The fixing unit 8 is positioned at the rear of the process cartridge 3. The fixing unit 8 has a heating roller 32 and a pressing roller 33 configured to be in contact with the heating roller 32.

The reading unit 35 is positioned above the apparatus main body 2. The reading unit 35 is positioned above the sheet discharging tray 12 at an interval. The reading unit 35 is a flatbed-type image scanner. The reading unit 35 is configured to read document image information.

2. Drum Cartridge

Figure 2A:
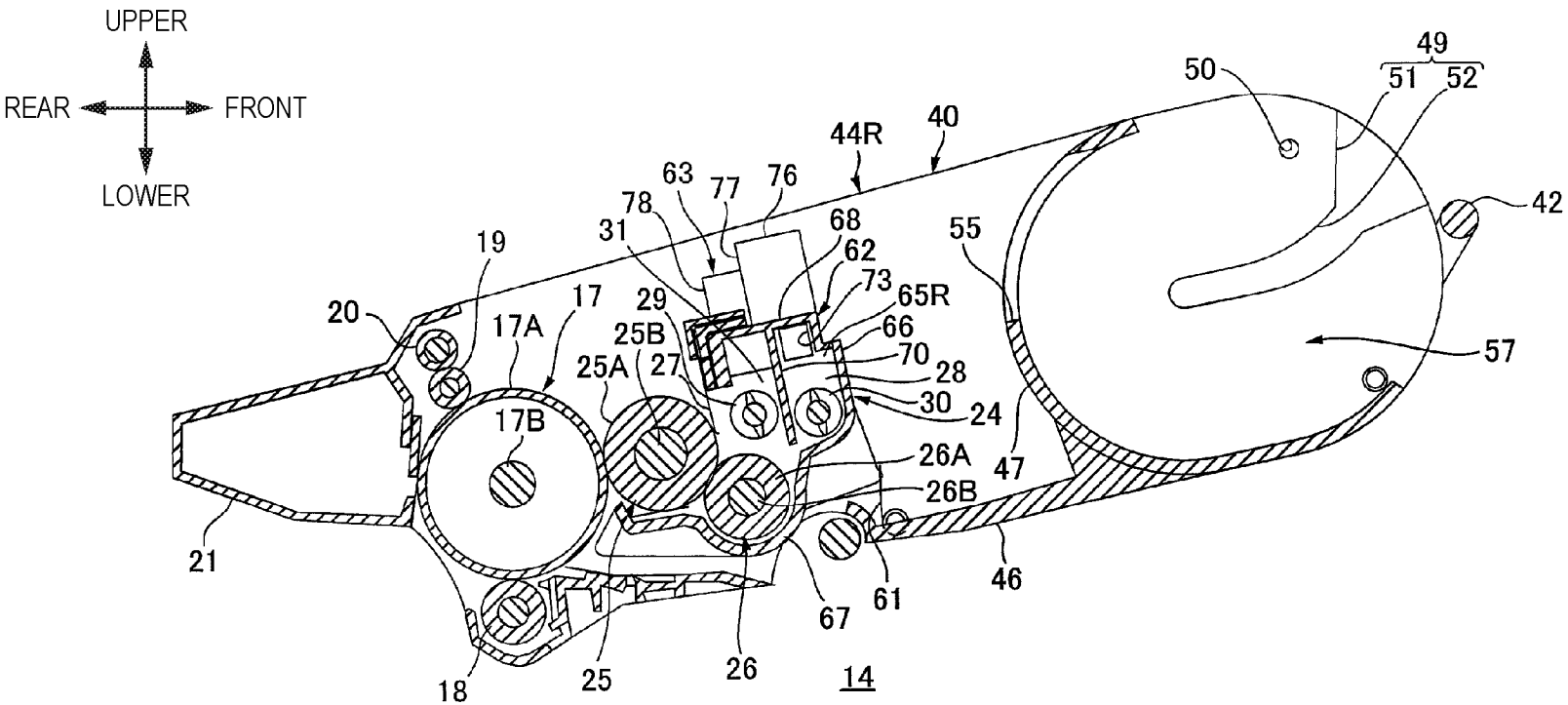
FIG. 2A is a central sectional view of a drum cartridge shown in FIG. 1.
Figure 3:
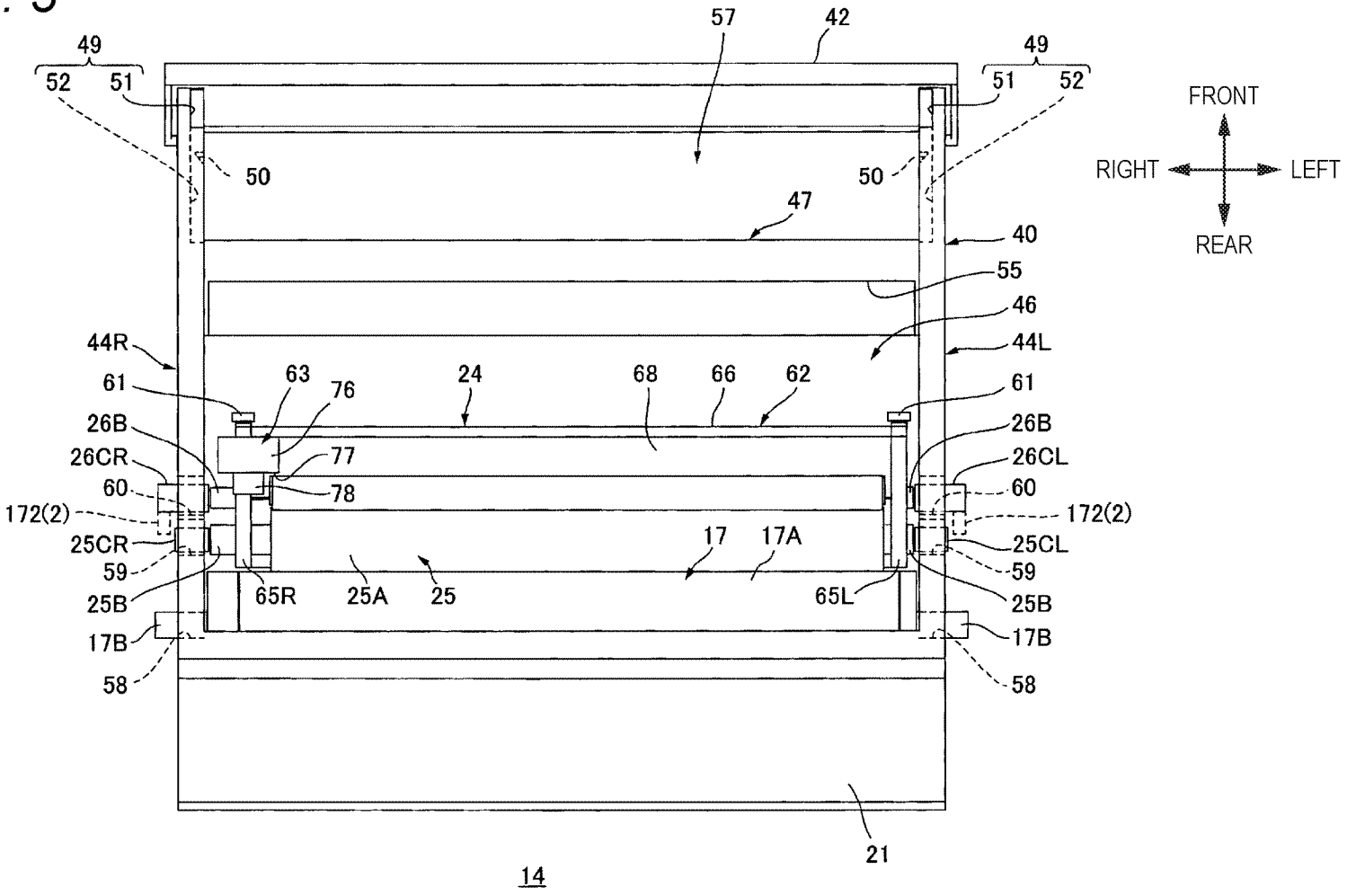
FIG. 3 is a plan view of the drum cartridge shown in FIG. 2A.

As shown in FIGS. 2A and 3, the drum unit 14 has a frame 40 configured to support the photosensitive drum 17 and the developing device 24.

(1) Frame

The frame 40 has a right sidewall 44R, a left sidewall 44L, a lower wall 46, a partition wall 47 having an insertion hole 55 in which a conveyance unit 86 of the toner cartridge 15 (which will be described later) is to be inserted, and a drum handle 42.

The sidewall 44R has a guide part 49, a fixing hole 50 in which a first rod 161 (which will be described later) of the toner cartridge 15 is to be fitted, a hole 58 in which the photosensitive drum 17 is to be inserted, a first long hole 59, which is an example of the second guide in which the developing roller 25 is to be inserted, and a second long hole 60 which is an example of the second guide in which the supply roller 26 is to be inserted.

Also, the sidewall 44L has a guide part 49, a fixing hole 50, a hole 58, a first long hole 59 and a second long hole 60, like the sidewall 44R.

Incidentally, the guide part 49 and the fixing hole 50 will be described with respect to the sidewall 44R, and the hole 58, the first long hole 59 and the second long hole 60 will be described with respect to the sidewall 44L.

The sidewall 44R is positioned at a right end portion of the frame 40. The sidewall 44R extends in the upper-lower and front-rear directions. The sidewall 44R has a plate shape.

The guide part 49 is positioned at a front end portion of the sidewall 44R. The guide part 49 is recessed outward in the left-right direction from an inner surface in the left-right direction of the sidewall 44R. The guide part 49 has a first recess 51 and a second recess 52, which is an example of the first guide.

As shown in FIG. 2A, the first recess 51 extends from a front-upper end portion of the sidewall 44R toward a rear-lower side. A width of the first recess 51 gradually decreases as the first recess toward the rear-lower side. The first recess 51 has a substantially triangular shape, as seen from a side view.

The second recess 52 continues from a rear-lower end portion of the first recess 51. The second recess 52 extends rearward from the rear-lower end portion of the first recess 51. Specifically, the second recess 52 has a curved part, which is curved rearward from the rear-lower end portion of the first recess 51, and a linear part extending rearward from a rear end portion of the curved part. The linear part of the second recess 52 extends along a moving direction of the developing device 24, which will be described later.

As shown in FIGS. 2A and 3, the fixing hole 50 is positioned at the rear of the first recess 51 and above a front end portion of the second recess 52. The fixing hole 50 is recessed outward in the left-right direction from an inner surface in the left-right direction of the sidewall 44R. The fixing hole 50 has a circular shape, as seen from a side.

Figure 2B:
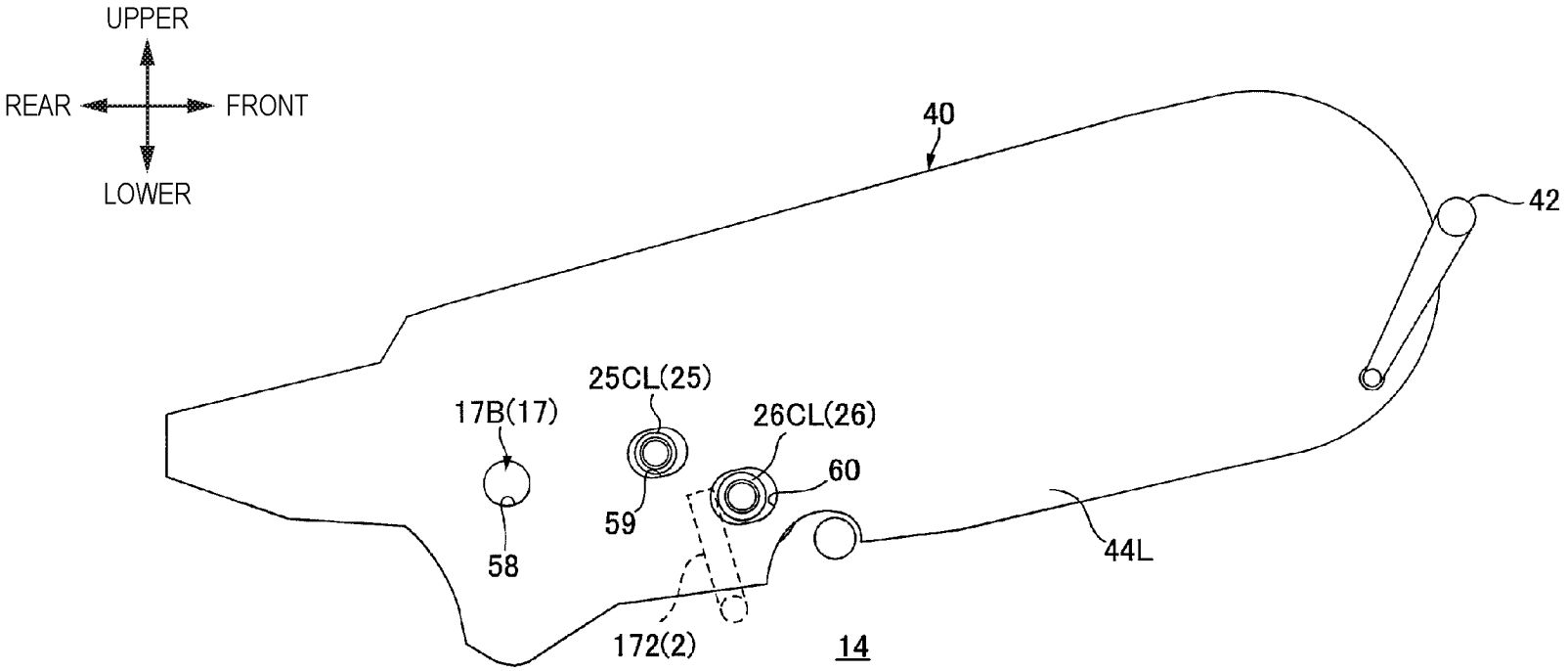
FIG. 2B is a side view of the drum cartridge shown in FIG. 2A.

As shown in FIGS. 2B and 3, the sidewall 44L is located at a left end portion of the frame 40. The sidewall 44L extends in the upper-lower and front-rear directions. The sidewall 44L has a plate shape.

The hole 58 is positioned in front of the drum cleaning unit 21, as seen in the left-right direction. The hole 58 is formed to penetrate the sidewall 44L in the left-right direction. The hole 58 has a circular shape, as seen from a side.

The first long hole 59 is positioned in front of the hole 58. The first long hole 59 is formed to penetrate the sidewall 44L in the left-right direction. The first long hole 59 has a long hole shape extending in the front-rear direction.

The second long hole 60 is positioned at a front-lower side of the first long hole 59. The second long hole 60 is formed to penetrate the sidewall 44L in the left-right direction. The second long hole 60 has a long hole shape extending in the front-rear direction.

As shown in FIGS. 2B and 3, the lower wall 46 is positioned at a lower end portion of the frame 40. The lower wall 46 is positioned between a lower end portion of the sidewall 44R and a lower end portion of the sidewall 44L. The lower wall 46 extends in the left-right and front-rear directions. The lower wall 46 has a plate shape. The lower wall 46 has two springs 61.

The two springs 61 are positioned at a substantial center in the front-rear direction of the lower wall 46. The two springs 61 are positioned in front of the developing device 24. The two springs 61 are positioned at an interval in the left-right direction. The spring 61 is a coil spring. A base end of the spring 61 is fixed to the lower wall 46. A free end of the spring 61 extends upward.

The partition wall 47 is positioned at the rear of the second recesses 52 of the sidewall 44R and the sidewall 44L, as seen in the left-right direction. The partition wall 47 is positioned between the developing device 24 and the second recess 52. The partition wall 47 extends upward from a substantial center in the front-rear direction of the lower wall 46. The partition wall 47 is positioned between the sidewall 44R and the sidewall 44L. The partition wall 47 is curved forward as it faces upward. The partition wall 47 has a substantial arc shape of which a center is a rear end portion of the second recess 52.

The insertion hole 55 is positioned at an upper part of the partition wall 47. The insertion hole 55 is formed to penetrate the partition wall 47 in the front-rear direction. The insertion hole 55 extends in the left-right direction. The insertion hole 55 has a substantially rectangular shape, as seen from the front.

Also, although described in detail later, the toner cartridge 15 is mounted to the frame 40 at the front of the partition wall 47. Like this, a part of the frame 40 defined by the front parts of the partition wall 47 and the lower wall 46 and the front parts of the sidewall 44R and the sidewall 44L is a toner cartridge mounting part 57. That is, the guide part 49 and the fixing hole 50 are provided for the toner cartridge mounting part 57.

The drum handle 42 is positioned at a front end portion of the drum unit 14. The drum handle 42 is configured to rotate between an erection position at which it extends in a front-upper direction and a tilted position (not shown) tilted forward from the erection position about a lower end portion thereof serving as a support point. The drum handle 42 is always urged toward the erection position by an urging member (not shown).

(2) Photosensitive Drum

The photosensitive drum 17 has a drum main body 17A and a drum shaft 17B.

The drum main body 17A is positioned at a periphery part of the photosensitive drum 17 in a radial direction of the photosensitive drum 17. The drum main body 17A extends in the left-right direction. The drum main body 17A has a cylinder shape of which both end portions in the left-right direction are closed.

The drum shaft 17B is positioned at a center of the photosensitive drum 17 in the radial direction of the photosensitive drum 17. The drum shaft 17B extends in the left-right direction. The drum shaft 17B has a cylinder shape. As shown in FIG. 3, a right end portion of the drum shaft 17B more protrudes rightward than a right end portion of the drum main body 17A. The right end portion of the drum shaft 17B is inserted into the hole 58 of the sidewall 44R. Thereby, the right end portion of the drum shaft 17B is rotatably supported to the sidewall 44R. The right end portion of the drum shaft 17B more protrude rightward than the sidewall 44R. A left end portion of the drum shaft 17B more protrudes leftward than a left end portion of the drum main body 17A. The left end portion of the drum shaft 17B is inserted in the hole 58 of the sidewall 44L. Thereby, the left end portion of the drum shaft 17B is rotatably supported to the sidewall 44L. The left end portion of the drum shaft 17B more protrudes leftward than the sidewall 44L.

(3) Developing Device

As shown in FIG. 2A, the developing device 24 is positioned at a substantial center in the front-rear direction of the drum unit 14. The developing device 24 has a developing frame 62 configured to support the developing roller 25 and the supply roller 26, a first screw 29, a second screw 30 and a receiving part 63.

(3-1) Developing Frame

As shown in FIGS. 2A and 3, the developing frame 62 has a right sidewall 65R, a left sidewall 65L, a front wall 66, a lower wall 67, an upper wall 68 having a toner receiving port 73, and a partition wall 70.

The sidewall 65R is positioned at a right end portion of the developing frame 62. The sidewall 65R extends in the upper-lower and front-rear directions. The sidewall 65R has a plate shape.

The sidewall 65L is positioned at a left end portion of the developing frame 62. The sidewall 65L extends in the upper-lower and front-rear directions. The sidewall 65L has a plate shape.

The front wall 66 is positioned at a front end portion of the developing frame 62. The front wall 66 is positioned between a front end portion of the sidewall 65R and a front end portion of the sidewall 65L. The lower wall 67 extends in the upper-lower and left-right directions. The front wall 66 has a plate shape.

As shown in FIG. 2A, the lower wall 67 is positioned at a lower end portion of the developing frame 62. The lower wall 67 is positioned between a lower end portion of the sidewall 65R and a lower end portion of the sidewall 65L. The lower wall 67 extends in the front-rear and left-right directions. The lower wall 67 has a plate shape. A front end portion of the lower wall 67 is connected to a lower end portion of the front wall 66.

As shown in FIGS. 2A and 3, the upper wall 68 is positioned at an upper end portion of the developing frame 62. The upper wall 68 is positioned between an upper end portion of the sidewall 65R and an upper end portion of the sidewall 65L. The upper wall 68 extends in the front-rear and left-right directions. As shown in FIG. 2A, a front end portion of the upper wall 68 is connected to an upper end portion of the front wall 66. The upper wall 68 has a concave arc part at a right end portion thereof, which is recessed downward in an arc shape along an outer peripheral surface of the receiving part 63, which will be described later. A rear end portion of the upper wall 68 is bent downward. The rear end portion of the upper wall 68 is configured to support the layer thickness regulation blade 27.

Figure 4A:
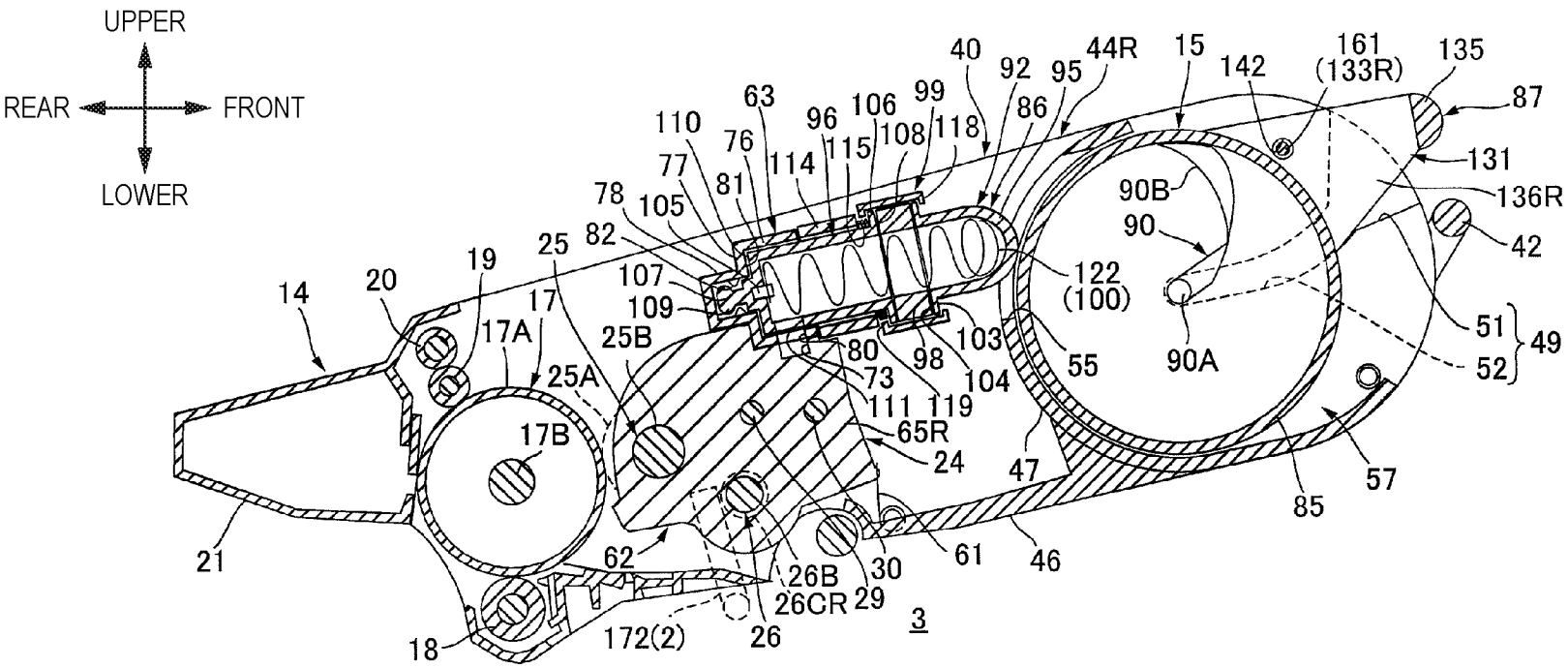
FIG. 4A depicts a process cartridge shown in FIG. 1, illustrating a state where a developing roller is in contact with a photosensitive drum.

As shown in FIGS. 2A and 4A, the toner receiving port 73 is positioned at a right end portion of the upper wall 68. The toner receiving port 73 is positioned in front of the partition wall 70. The toner receiving port 73 is formed to penetrate the arc part of the upper wall 68 in the upper-lower direction.

As shown in FIG. 2A, the partition wall 70 is positioned at the rear of the front wall 66. The partition wall 70 is positioned between the sidewall 65R and the sidewall 65L. The partition wall 70 extends downward from a substantial center in the front-rear direction of the upper wall 68. The partition wall 70 has a plate shape. A lower end portion of the partition wall 70 is positioned in front of the supply roller 26. The lower end portion of the partition wall 70 is positioned above the lower wall 67 at an interval.

The partition wall 70 partitions an internal space of the developing frame 62 into a developing part 31 at the rear of the partition wall 70 and a toner accommodation part 28 in front of the partition wall 70.

(3-2) Developing Roller

As shown in FIGS. 2A and 3, the developing roller 25 has a developing covering part 25A, a developing shaft 25B, a right developing collar 25CR and a left developing collar 25CL.

The developing covering part 25A is positioned at an outer periphery part of the developing roller 25 in the radial direction of the developing roller 25. The developing covering part 25A extends in the left-right direction. The developing covering part 25A has a cylinder shape.

The developing shaft 25B is positioned at a center of the developing roller 25 in the radial direction of the developing roller 25. The developing shaft 25B extends in the left-right direction. The developing shaft 25B has a cylinder shape. A right end portion of the developing shaft 25B more protrudes rightward than a right end portion of the developing covering part 25A. The right end portion of the developing shaft 25B is rotatably supported to the sidewall 65R. The right end portion of the developing shaft 25B more protrudes rightward than the sidewall 65R. A left end portion of the developing shaft 25B more protrudes leftward than a left end portion of the developing covering part 25A. The left end portion of the developing shaft 25B is rotatably supported to the sidewall 65L. The left end portion of the developing shaft 25B more protrudes leftward than the sidewall 65L.

As shown in FIG. 3, the developing collar 25CR is positioned at a right end portion of the developing roller 25. The developing collar 25CR extends in the left-right direction. The developing collar 25CR has a cylinder shape. The developing collar 25CR is fitted to the right end portion of the developing shaft 25B. The developing collar 25CR is fitted to the first long hole 59 of the sidewall 44R. The developing collar 25CR more protrudes outward in the left-right direction than the sidewall 44R.

As shown in FIGS. 2B and 3, the developing collar 25CL is positioned at a left end portion of the developing roller 25. The developing collar 25CL extends in the left-right direction. The developing collar 25CL has a cylinder shape. The developing collar 25CL is fitted to the left end portion of the developing shaft 25B. The developing collar 25CL is fitted to the first long hole 59 of the sidewall 44L. The developing collar 25CL more protrudes outward in the left-right direction than the sidewall 44L.

(3-3) Supply Roller

As shown in FIGS. 2A and 3, the supply roller 26 has a supply covering part 26A, a supply shaft 26B, a right supply collar 26CR and a left supply collar 26CL.

The supply covering part 26A is positioned at an outer periphery part of the supply roller 26 in a radial direction of the supply roller 26. The supply covering part 26A extends in the left-right direction. The supply covering part 26A has a cylinder shape.

The supply shaft 26B is positioned at a center of the supply roller 26 in the radial direction of the supply roller 26. The supply shaft 26B extends in the left-right direction. The supply shaft 26B has a cylinder shape. A right end portion of the supply shaft 26B more protrudes rightward than a right end portion of the supply covering part 26A. The right end portion of the supply shaft 26B is rotatably supported to the sidewall 65R. The right end portion of the supply shaft 26B more protrudes rightward than the sidewall 65R. A left end portion of the supply shaft 26B more protrude leftward than a left end portion of the supply covering part 26A. The left end portion of the supply shaft 26B is rotatably supported to the sidewall 65L. The left end portion of the supply shaft 26B more protrudes leftward than the sidewall 65L.

As shown in FIG. 3, the supply collar 26CR is positioned at a right end portion of the supply roller 26. The supply collar 26CR extends in the left-right direction. The supply collar 26CR has a cylinder shape. The supply collar 26CR is fitted to the right end portion of the supply shaft 26B. The supply collar 26CR is fitted to the second long hole 60 of the sidewall 44R. The supply collar 26CR more protrudes outward in the left-right direction than the sidewall 44R.

As shown in FIGS. 2B and 3, the supply collar 26CL is positioned at a left end portion of the supply roller 26. The supply collar 26CL extends in the left-right direction. The supply collar 26CL has a cylinder shape. The supply collar 26CL is fitted to the left end portion of the supply shaft 26B. The supply collar 26CL is fitted to the second long hole 60 of the sidewall 44L. The supply collar 26CL more protrudes outward in the left-right direction than the sidewall 44L.

(3-4) First Screw and Second Screw

As shown in FIG. 2A, the first screw 29 is positioned in the developing part 31. Specifically, the first screw 29 is positioned above the supply roller 26 and at the rear of the partition wall 70. A right end portion of the first screw 29 is rotatably supported to the sidewall 65R. A left end portion of the first screw 29 is rotatably supported to the sidewall 65L.

The second screw 30 is positioned in the toner accommodation part 28. That is, the second screw 30 is positioned in front of the partition wall 70. A right end portion of the second screw 30 is rotatably supported to the sidewall 65R. A left end portion of the second screw 30 is rotatably supported to the sidewall 65L.

(3-5) Receiving Part

As shown in FIGS. 3 and 4A, the receiving part 63 is positioned at a right-upper end portion of the developing device 24. The receiving part 63 is fixed to the developing frame 62. As shown in FIG. 4A, the receiving part 63 has a cylinder part 76 having a communication port 80 and a closed part 77.

The cylinder part 76 is positioned above the toner receiving port 73 of the developing frame 62. The cylinder part 76 extends in the front-rear direction. The cylinder part 76 has a cylinder shape.

The communication port 80 is formed to penetrate a lower circumferential surface of the cylinder part 76 in the upper-lower direction. The communication port 80 has a substantially rectangular shape, as seen from a bottom. The communication port 80 coincides with the toner receiving port 73 of the developing frame 62 in the upper-lower direction.

The closed part 77 is positioned at a rear end portion of the cylinder part 76. The closed part 77 is configured to close the rear end portion of the cylinder part 76. The closed part 77 has a circular shape, as seen from the front. A front surface of the cylinder part 76 is a first contact surface 81. Also, the closed part 77 has a concave portion 78.

The first contact surface 81 extends in a circumferential direction of the cylinder part 76. That is, the first contact surface 81 extends in a direction substantially perpendicular to a moving direction of the developing device 24, which will be described later. Incidentally, the term 'substantially perpendicular' indicates 75° or greater, preferably 80° or greater, and more preferably 85° or greater and 105° or smaller, preferably 100° or smaller, and more preferably 95° or smaller, for example. Specifically, the term 'substantially perpendicular' indicates 90°.

The concave portion 78 is recessed rearward from a substantial center in a radial direction of the closed part 77. The concave portion 78 has a substantial cylinder shape of which a rear end portion is closed. The concave portion 78 has a plate spring 82.

The plate spring 82 protrudes inward in a radial direction of the concave portion 78 from an inner peripheral surface of the concave portion 78.

(4) Mounted State of Developing Device to Drum Cartridge

As described above, the developing collar 25CR is fitted to the first long hole 59 of the sidewall 44R, the developing collar 25CL is fitted to the first long hole 59 of the sidewall 44L, the supply collar 26CR is fitted to the second long hole 60 of the sidewall 44R and the supply collar 26CL is fitted to the second long hole 60 of the sidewall 44L of the drum unit 14, so that the developing device 24 is supported to the frame 40 of the drum unit 14, as shown in FIGS. 2B and 3. Thereby, the developing device 24 can move in the front-rear direction along the first long hole 59 and the second long hole 60. That is, a moving direction of the developing device 24 is the front-rear direction. Also, the moving direction of the developing device 24 is substantially the same as the arrangement direction of the photosensitive drum 17 and the developing roller 25.

Also, a front-lower end portion of the sidewall 65R of the developing device 24 is in contact with a rear surface of a free end of the right spring 61. A front-lower end portion of the sidewall 65L of the developing device 24 is in contact with a free end of the left spring 61. Thereby, the developing device 24 is always pressed rearward along the first long hole 59 and the second long hole 60 by the two springs 61. In other words, the extension directions of the first long hole 59 and the second long hole 60 are the pressing directions of the springs 61.

3. Toner Cartridge (1) Configuration of Toner Cartridge

Figure 5:
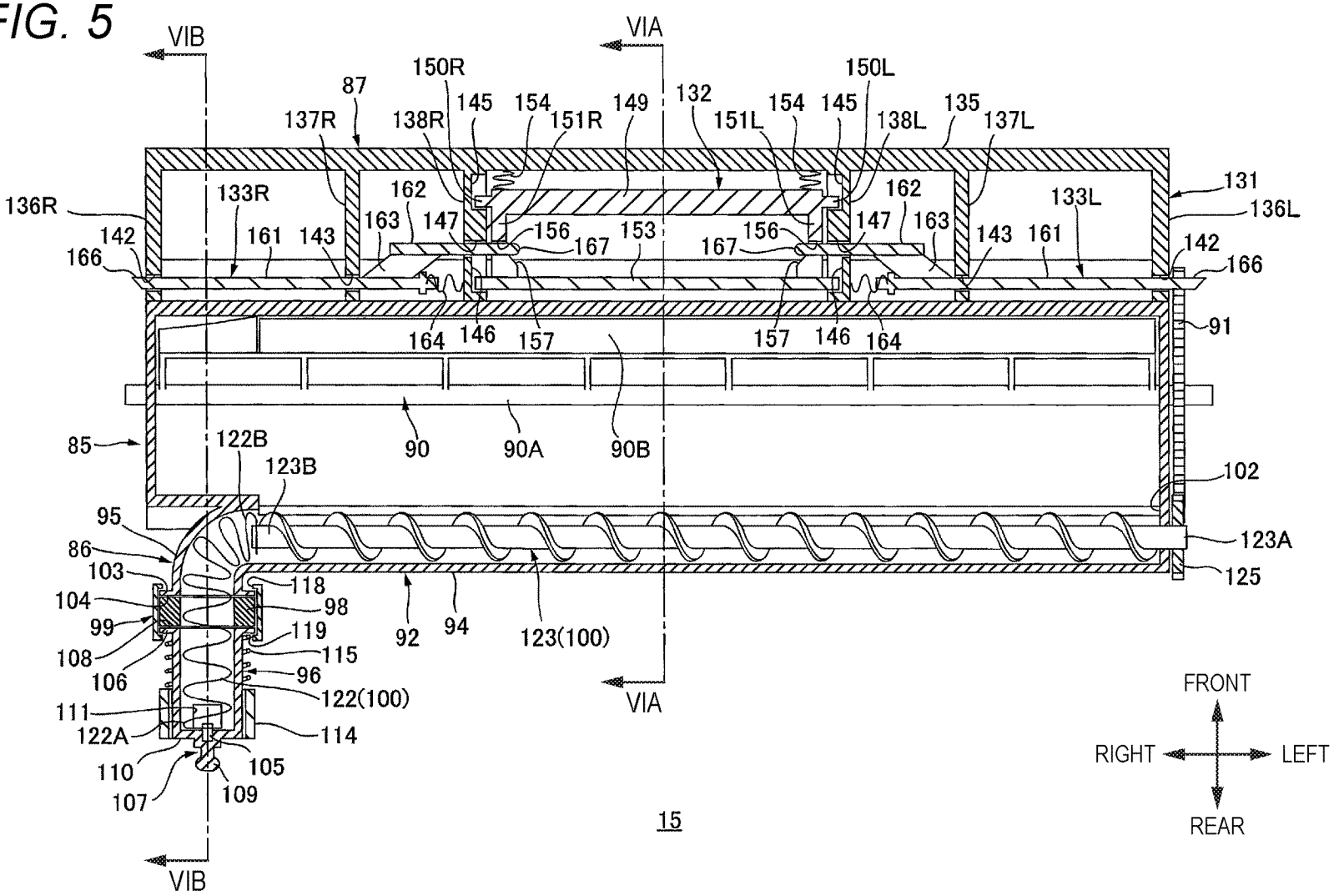
FIG. 5 is a sectional view taken along a line V-V of a toner cartridge shown in FIG. 9.
Figure 6A:
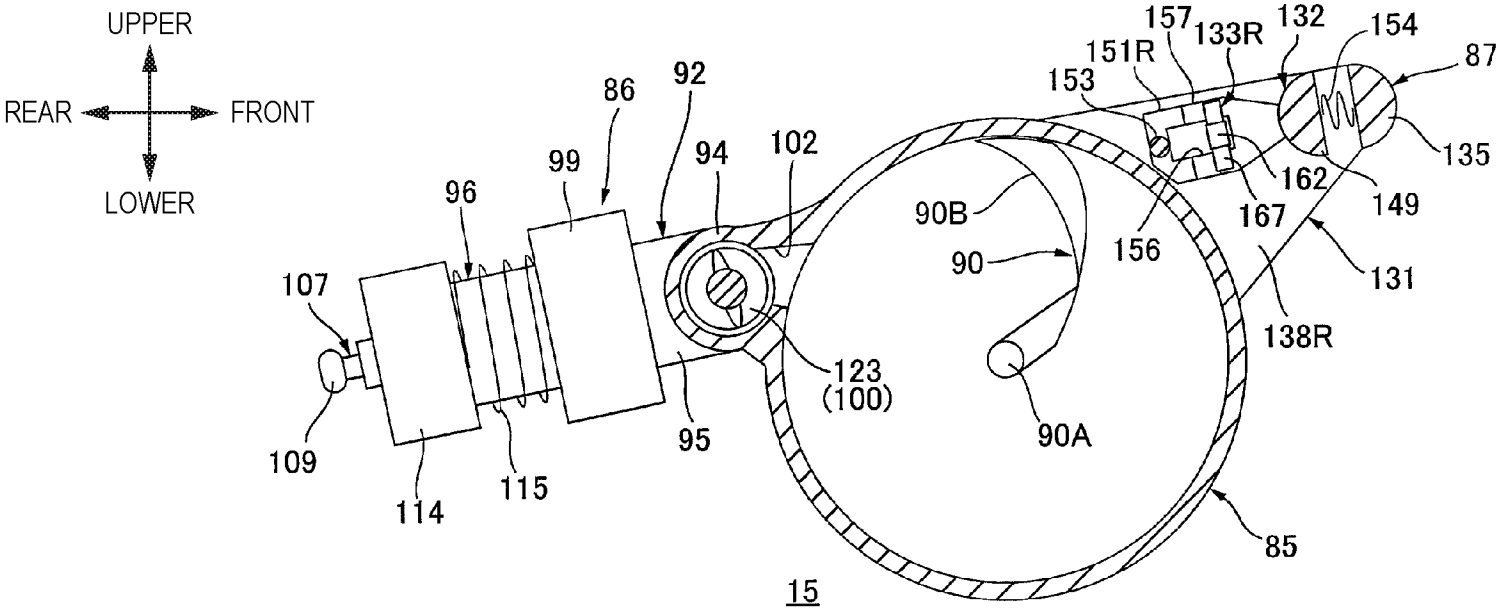
FIG. 6A is a sectional view taken along a line VIA-VIA of the toner cartridge shown in FIG. 5.

As shown in FIGS. 5 and 6A, the toner cartridge 15 has a toner accommodation part 85, a conveyance unit 86 and a handle unit 87.

(1-1) Toner Accommodation Part

The toner accommodation part 85 is configured to accommodate therein toner. The toner accommodation part 85 extends in the left-right direction. The toner accommodation part 85 has a substantial cylinder shape of which both end portions in the left-right direction are closed. The toner accommodation part 85 has an agitator 90.

The agitator 90 has an agitator shaft 90A, a blade 90B and an agitator gear 91.

The agitator shaft 90A is positioned at a center of the toner accommodation part 85, as seen in the left-right direction. The agitator shaft 90A extends in the left-right direction. The agitator shaft 90A has a cylinder shape. A right end portion of the agitator shaft 90A is rotatably supported to a right end portion of the toner accommodation part 85. The right end portion of the agitator shaft 90A more protrudes rightward than the right end portion of the toner accommodation part 85. A left end portion of the agitator shaft 90A is rotatably supported to a left end portion of the toner accommodation part 85. The left end portion of the agitator shaft 90A more protrudes leftward than the left end portion of the toner accommodation part 85.

The blade 90B is positioned in the toner accommodation part 85. The blade 90B extends outward in a radial direction of the agitator 90 from the agitator shaft 90A. The blade 90B is in contact with an inner surface of the toner accommodation part 85.

The agitator gear 91 is positioned at the left of the toner accommodation part 85. The agitator gear 91 is fixed to the left end portion of the agitator shaft 90A. The agitator gear 91 has gear teeth over an entire circumference thereof. The agitator gear 91 is configured to be rotatable together with the agitator shaft 90A.

(1-2) Conveyance Unit

The conveyance unit 86 is positioned at a rear-upper side of the toner accommodation part 85. The conveyance unit 86 has a conveyance tube 92 configured to convey the toner in the toner accommodation part 85 to the developing device 24, a coupling tube 96 having a toner supply port 111, a shutter 114, an urging member 115, a buffer member 98, a cover member 99 and a conveyance member 100.

The conveyance tube 92 has a first conveyance tube 94 having a communication port 102 and a second conveyance tube 95.

The first conveyance tube 94 is positioned at a rear-lower side of the toner accommodation part 85. The first conveyance tube 94 extends in the left-right direction. The first conveyance tube 94 has a substantial cylinder shape of which a left end portion is closed.

The communication port 102 is configured to penetrate a front end portion of the first conveyance tube 94 and a rear-upper end portion of the toner accommodation part 85 in the front-rear direction. The communication port 102 extends in the left-right direction. Thereby, the communication port 102 is configured to communicate the front end portion of the first conveyance tube 94 and the rear-upper end portion of the toner accommodation part 85.

Figure 6B:
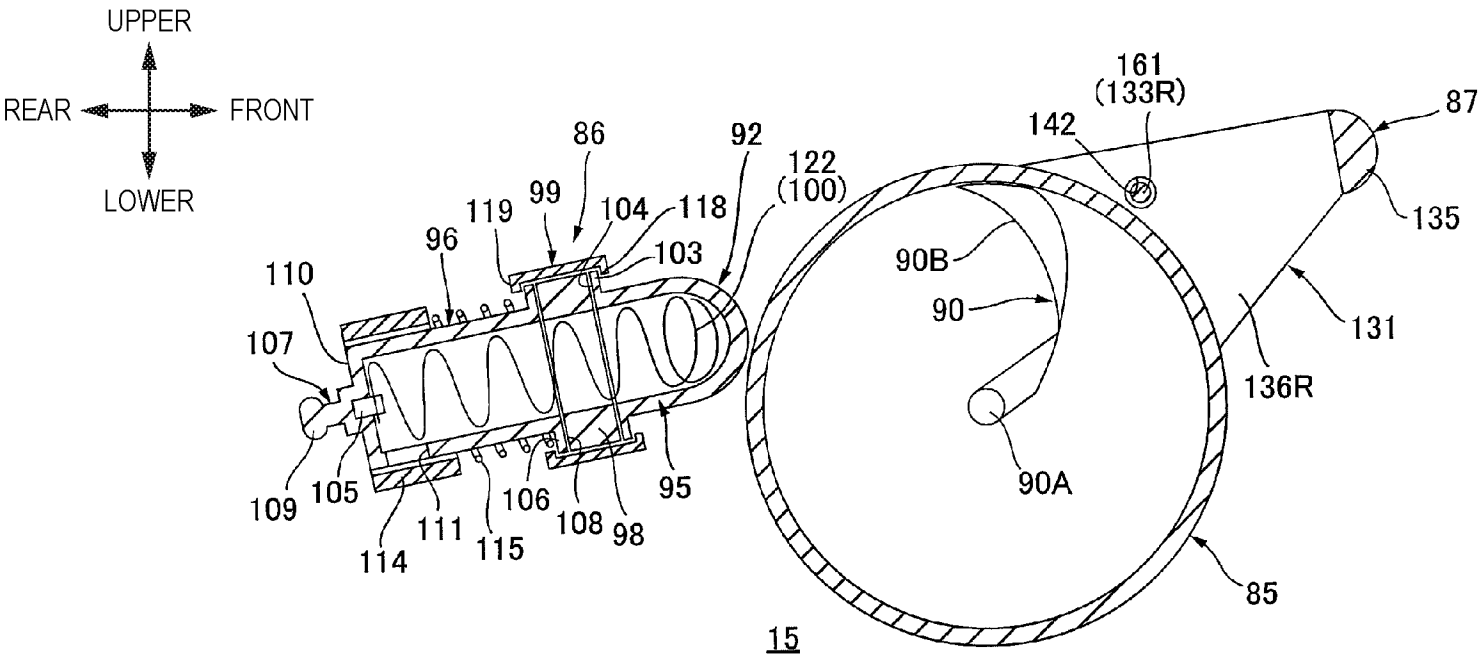
FIG. 6B is a sectional view taken along a line VIB-VIB of the toner cartridge shown in FIG. 5.

As shown in FIGS. 5 and 6B, the second conveyance tube 95 is positioned at the right of the first conveyance tube 94. The second conveyance tube 95 extends continuously rightward from a right end portion of the first conveyance tube 94, and is bent rearward. The second conveyance tube 95 has a substantial cylinder shape. The second conveyance tube 95 has a first flange part 103.

The first flange part 103 is positioned at a rear end portion of the second conveyance tube 95. The first flange part 103 protrudes outward in a radial direction of the second conveyance tube 95 from the rear end portion of the second conveyance tube 95. The first flange part 103 extends in a circumferential direction of the second conveyance tube 95. The first flange part 103 has a plate shape. A rear surface of the first flange part 103 is a first adhesion surface 104. The first adhesion surface 104 extends in the radial direction of the second conveyance tube 95. That is, the first adhesion surface 104 extends in a direction substantially perpendicular to the moving direction of the developing device 24.

The coupling tube 96 is positioned at the rear of the second conveyance tube 95 at an interval. The coupling tube 96 extends in the front-rear direction, i.e., the moving direction of the developing device 24. The coupling tube 96 has a substantial cylinder shape of which a rear end portion is closed. A rear surface of the coupling tube 96 is a second contact surface 110. The second contact surface 110 extends in a radial direction of the coupling tube 96. That is, the second contact surface 110 extends in a direction substantially perpendicular to the moving direction of the developing device 24.

Also, the coupling tube 96 has a second flange part 106, a convex portion 107 and a fitting 105.

The second flange part 106 is positioned at a front end portion of the coupling tube 96. The second flange part 106 protrudes outward in the radial direction of the coupling tube 96 from the front end portion of the coupling tube 96. The second flange part 106 extends in a circumferential direction of the coupling tube 96. The second flange part 106 has a plate shape. A front surface of the second flange part 106 is a second adhesion surface 108. The second adhesion surface 108 extends in the radial direction of the coupling tube 96. That is, the second adhesion surface 108 extends in a direction substantially perpendicular to the moving direction of the developing device 24.

The convex portion 107 is positioned at a rear end portion of the coupling tube 96. The convex portion 107 protrudes rearward from the rear end portion of the coupling tube 96. The convex portion 107 has a substantial cylinder shape. The convex portion 107 has a protrusion 109.

The protrusion 109 is positioned at a rear end portion of the convex portion 107. The protrusion 109 protrudes outward in a radial direction of the convex portion 107 from a circumferential surface of the convex portion 107. The protrusion 109 extends in a circumferential direction of the convex portion 107. The protrusion 109 has a substantial arc shape, as seen from a section.

The fitting 105 is positioned in front of the protrusion 109. The fitting 105 extends in the front-rear direction. The fitting 105 has a substantial cylinder shape. The fitting 105 is rotatably supported to the rear end portion of the coupling tube 96.

The toner supply port 111 is positioned at the rear end portion of the coupling tube 96. The toner supply port 111 is formed to penetrate a lower circumferential surface of the coupling tube 96 in the upper-lower direction. The toner supply port 111 has a substantially rectangular shape, as seen from a bottom.

The shutter 114 is positioned at a rear end portion of the toner cartridge 15. The shutter 114 is configured to cover the circumferential surface of the coupling tube 96. In other words, the shutter 114 is provided at the coupling tube 96. The shutter 114 extends in the front-rear direction. The shutter 114 has a substantial cylinder shape. A size in the front-rear direction of the shutter 114 is a substantial half of a size in the front-rear direction of the coupling tube 96. The shutter 114 can move between a closed position (refer to FIG. 6B) at which the toner supply port 111 of the coupling tube 96 is to be closed and an opening position (refer to FIGS. 4A and 4B) in front of the closed position, at which the toner supply port 111 of the coupling tube 96 is to be opened.

The urging member 115 is positioned in front of the shutter 114. The urging member 115 is wound to the coupling tube 96. The urging member 115 is a coil spring extending in the front-rear direction. A rear end portion of the urging member 115 is in contact with a front end portion of the shutter 114. A front end portion of the urging member 115 is in contact with a rear surface of the second flange part 106. The urging member 115 is configured to locate the shutter 114 at the closed position at a state of a natural length.

The buffer member 98 is positioned between the first flange part 103 and the second flange part 106. The buffer member 98 is made of urethane foam. Also, the buffer member 98 may be made of polyethylene foam or rubber sponge. The buffer member 98 can be deformed. The buffer member 98 has a substantially circular ring shape. A front surface of the buffer member 98 adheres to the first adhesion surface 104 of the first flange part 103. A rear surface of the buffer member 98 adheres to the second adhesion surface 108 of the second flange part 106. Thereby, the buffer member 98 is configured to seal between the second conveyance tube 95 and the coupling tube 96. Incidentally, the buffer member 98 is kept with being compressed in the front-rear direction between the first flange part 103 and the second flange part 106.

The cover member 99 is positioned at an outward side in a radial direction of the buffer member 98. The cover member 99 extends in the front-rear direction. The cover member 99 has a substantial cylinder shape. A front end portion of the cover member 99 is positioned in front of the first flange part 103 of the second conveyance tube 95. A rear end portion of the cover member 99 is positioned at the rear of the second flange part 106 of the coupling tube 96. The cover member 99 has a first restraint part 118 and a second restraint part 119.

The first restraint part 118 is positioned at a front end portion of the cover member 99. The first restraint part 118 protrudes inward in a radial direction of the cover member 99. The first restraint part 118 extends in a circumferential direction of the cover member 99. The cover member 99 has a plate shape. A rear surface of the first restraint part 118 is configured to face a front surface the first flange part 103 of the second conveyance tube 95. Incidentally, the front surface of the first flange part 103 of the second conveyance tube 95 is pressed to the rear surface of the first restraint part 118 by an elastic force of the buffer member 98 to be compressed in the front-rear direction.

The second restraint part 119 is positioned at a rear end portion of the cover member 99. The second restraint part 119 protrudes inward in the radial direction of the cover member 99. The second restraint part 119 extends in the circumferential direction of the cover member 99. The second restraint part 119 has a plate shape. A front surface of the second restraint part 119 is configured to face a rear surface of the second flange part 106 of the coupling tube 96. Incidentally, the rear surface of the second flange part 106 of the coupling tube 96 is pressed to the front surface of the second restraint part 119 by the elastic force of the buffer member 98 to be compressed in the front-rear direction.

In this way, the coupling tube 96 is connected to the second conveyance tube 95 by the cover member 99 and the buffer member 98.

The conveyance member 100 is configured to convey the toner in the toner accommodation part 85 toward the toner supply port 111. The conveyance member 100 has an auger screw 123, which is an example of the second conveyance member, and a coil spring 122, which is an example of the first conveyance member.

As shown in FIGS. 5 and 6A, the auger screw 123 is positioned in the first conveyance tube 94. The auger screw 123 extends in the left-right direction. A left end portion 123A (third end portion) of the auger screw 123 is rotatably supported to a left wall of the first conveyance tube 94. The left end portion 123A more protrudes leftward than the left wall of the first conveyance tube 94. A right end portion 123B (fourth end portion) of the auger screw 123 is positioned in a right end portion of the first conveyance tube 94. The right end portion 123B of the auger screw 123 is an opposite end portion to the left end portion 123A in the left-right direction. Also, the auger screw 123 has a conveyance gear 125.

The conveyance gear 125 is positioned at the left of the first conveyance tube 94. The conveyance gear 125 is fixed to the left end portion 123A of the auger screw 123. In other words, the conveyance gear 125 is positioned at an opposite end portion to the coupling tube 96 in the left-right direction. The conveyance gear 125 has gear teeth over an entire circumference thereof. The conveyance gear 125 is configured to be rotatable together with the auger screw 123. The conveyance gear 125 is configured to mesh with the agitator gear 91.

As shown in FIGS. 5 and 6B, the coil spring 122 is positioned in the second conveyance tube 95 and the coupling tube 96. In other words, at least a part of the coil spring 122 is positioned in the coupling tube 96. The coil spring 122 is configured to expand and contract. The coil spring 122 is curved along the second conveyance tube 95 and the coupling tube 96. A rear end portion 122A (first end portion) of the coil spring 122 is positioned at the rear end portion of the coupling tube 96. The rear end portion 122A of the coil spring 122 is coupled to the fitting 105 of the coupling tube 96. A front end portion 122B of the coil spring 122 is positioned at a front end portion of the second conveyance tube 95. The front end portion 122B (second end portion) of the coil spring 122 is an opposite end portion to the rear end portion 122A in the front-rear direction. The front end portion 122B of the coil spring 122 is coupled to the right end portion 123B of the auger screw 123. Thereby, the coil spring 122 can rotate together with the auger screw 123.

(1-3) Handle Unit

As shown in FIGS. 5 and 6A, the handle unit 87 is positioned at the front end portion of the toner cartridge 15. The handle unit 87 has a fixed handle 131, a moveable handle 132, a right interlocking part 133R and a left interlocking part 133L.

The fixed handle 131 has a first grip 135, a right first wall 136R having a hole 142 in which a first rod 161 of the interlocking part 133R (which will be described later) is to be inserted, a left first wall 136L having a hole 142 in which the first rod 161 of the interlocking part 133L (which will be described later) is to be inserted, a right second wall 137R having a hole 143 in which the first rod 161 of the interlocking part 133R (which will be described later) is to be inserted, a left second wall 137L having a hole 143 in which the first rod 161 of the interlocking part 133L (which will be described later) is to be inserted, a right third wall 138R having a first recess 145, a second recess 146 and a hole 147 in which a second rod 162 of the interlocking part 133R (which will be described later) is to be inserted, and a left third wall 138L having a first recess 145, a second recess 146 and a hole 147 in which the second rod 162 of the interlocking part 133R (which will be described later) is to be inserted.

The first grip 135 is positioned at a front end portion of the fixed handle 131. The first grip 135 extends in the left-right direction. The first grip 135 has a substantially semicircular section protruding forward.

As shown in FIGS. 5 and 6B, the first wall 136R is positioned at a right end portion of the fixed handle 131. The first wall 136R extends forward from a front end portion of the toner accommodation part 85. The first wall 136R has a substantially triangular shape of which a size in the upper-lower direction gradually decreases as it faces forward, as seen from a side. A front end portion of the first wall 136R is connected to a right end portion of the first grip 135.

The hole 142 is positioned at a rear end portion of the first wall 136R. The hole 142 is formed to penetrate the first wall 136R in the left-right direction. The hole 142 has a circular shape, as seen from a side.

As shown in FIG. 5, the first wall 136L is positioned at a left end portion of the fixed handle 131. The first wall 136L extends forward from the front end portion of the toner accommodation part 85. Although not shown, when projected in the left-right direction, the first wall 136L has the same shape as the first wall 136R. A front end portion of the first wall 136L is connected to a left end portion of the first grip 135.

The second wall 137R is positioned at the left of the first wall 136R. The second wall 137R extends forward from the front end portion of the toner accommodation part 85. Although not shown, when projected in the left-right direction, the second wall 137R has the same shape as the first wall 136R. A front end portion of the second wall 137R is connected to the first grip 135.

The hole 143 is positioned at a rear end portion of the second wall 137R. The hole 143 is formed to penetrate the second wall 137R in the left-right direction. The hole 143 has a circular shape, as seen from a side. When projected in the left-right direction, the hole 143 coincides with the hole 142 of the first wall 136R.

The second wall 137L is positioned at the right of the first wall 136L. The second wall 137L extends forward from the front end portion of the toner accommodation part 85. Although not shown, when projected in the left-right direction, the second wall 137L has the same shape as the second wall 137R. A front end portion of the second wall 137L is connected to the first grip 135.

The third wall 138R is positioned at the left of the second wall 137R. The third wall 138R extends forward from the front end portion of the toner accommodation part 85. As shown in FIGS. 6A and 6B, when projected in the left-right direction, the third wall 138R has the same shape as the first wall 136R. A front end portion of the third wall 138R is connected to the first grip 135.

As shown in FIG. 5, the first recess 145 is positioned at the front end portion of the third wall 138R. The first recess 145 is recessed outward in the left-right direction from an inner side in the left-right direction of the third wall 138R. The first recess 145 extends in the front-rear direction. The first recess 145 has a substantially rectangular shape, as seen from a side.

The second recess 146 is positioned at the rear of the first recess 145. The second recess 146 is recessed outward in the left-right direction from the inner side in the left-right direction of the third wall 138R. The second recess 146 extends in the front-rear direction. The second recess 146 has a substantially rectangular shape, as seen from a side.

The hole 147 is positioned at a front end portion of the second recess 146. The hole 147 is formed to penetrate the third wall 138R in the left-right direction. The hole 147 has a substantially rectangular shape, as seen from a side.

The third wall 138L is positioned at the right of the second wall 137L. The third wall 138L extends forward from the front end portion of the toner accommodation part 85. Although not shown, when projected in the left-right direction, the third wall 138L has the same shape as the first wall 136R. A front end portion of the third wall 138L is connected to the first grip 135.

As shown in FIG. 5, the moveable handle 132 is positioned at a substantial center in the left-right direction of the handle unit 87. Specifically, the moveable handle 132 is positioned between the third wall 138R and the third wall 138L in the left-right direction and between the toner accommodation part 85 and the first grip 135 in the front-rear direction. The moveable handle 132 has a second grip 149, a right boss 150R, a left boss 150L, a right fourth wall 151R having a hole 156 in which a second rod 162 of the interlocking part 133R (which will be described later) is to be inserted, a left fourth wall 151L having the hole 156 in which the second rod 162 of the interlocking part 133L (which will be described later) is to be inserted, a coupling part 153 and two urging members 154.

As shown in FIGS. 5 and 6A, the second grip 149 is positioned at a front end portion of the moveable handle 132. The second grip 149 extends in the left-right direction. The second grip 149 has a substantially semicircular section protruding rearward.

As shown in FIG. 5, the boss 150R is positioned at the right of the second grip 149. The boss 150R protrudes rightward from a right end portion of the second grip 149. The boss 150R has a cylinder shape. The boss 150R is fitted to the first recess 145 of the third wall 138R.

The boss 150L is positioned at the left of the second grip 149. The boss 150L protrudes leftward from a left end portion of the second grip 149. The boss 150L is fitted to the first recess 145 of the third wall 138L.

As shown in FIGS. 5 and 6A, the fourth wall 151R is positioned at a right end portion of the moveable handle 132. The fourth wall 151R is positioned at the left of the third wall 138R. The fourth wall 151R extends in the front-rear direction. The fourth wall 151R has a plate shape. A front end portion of the fourth wall 151R is connected to a right end portion of the second grip 149. The fourth wall 151R has an inclined part 157.

The inclined part 157 is positioned at a rear end portion of the fourth wall 151R. The inclined part 157 is inclined inward in the left-right direction as it faces rearward, from an inner surface in the left-right direction of the fourth wall 151R.

The hole 156 is positioned at a rear part of the fourth wall 151R. The hole 156 is formed to penetrate the fourth wall 151R in the left-right direction. The hole 156 has a substantially rectangular shape, as seen from a side. The hole 156 is formed to overlap with the inclined part 157.

As shown in FIG. 5, the fourth wall 151L is positioned at a left end portion of the moveable handle 132. The fourth wall 151L is positioned at the right of the third wall 138L. The fourth wall 151L extends in the front-rear direction. The fourth wall 151L has a plate shape. A front end portion of the fourth wall 151L is connected to the left end portion of the second grip 149. The fourth wall 151L has an inclined part 157, like the fourth wall 151R.

As shown in FIGS. 5 and 6A, the coupling part 153 is positioned at a rear end portion of the moveable handle 132. The coupling part 153 extends in the left-right direction. The coupling part 153 has a cylinder shape. The coupling part 153 is connected to a rear end portion of the fourth wall 151R and a rear end portion of the fourth wall 151L. As shown in FIG. 5, a right end portion of the coupling part 153 more protrudes rightward than the fourth wall 151R. The right end portion of the coupling part 153 is fitted to the second recess 146 of the third wall 138R. A left end portion of the coupling part 153 more protrudes leftward than the fourth wall 151L. The left end portion of the coupling part 153 is fitted to the second recess 146 of the third wall 138L.

The two urging members 154 are positioned between the second grip 149 and the first grip 135 of the fixed handle 131. The two urging members 154 are positioned at an interval in the left-right direction. The urging member 154 is a coil spring extending in the front-rear direction. A front end portion of the urging member 154 is in contact with a rear surface of the first grip 135. A rear end portion of the urging member 154 is in contact with a front surface of the second grip 149. The urging member 154 is configured to always urge rearward the moveable handle 132 so that the moveable handle separates from the first grip 135.

In this way, the moveable handle 132 can move to a first position (refer to FIG. 7) by the urging forces of the urging members 154, at which the boss 150R is positioned at a rear end portion of the first recess 145 of the third wall 138R, the boss 150L is positioned at a rear end portion of the first recess 145 of the third wall 138L, the right end portion of the coupling part 153 is positioned at the rear end portion of the second recess 146 of the third wall 138R and the left end portion of the coupling part 153 is positioned at the rear end portion of the second recess 146 of the third wall 138L and move to a second position (refer to FIG. 8) against the urging forces of the urging members 154, at which the boss 150R is positioned at a front end portion of the first recess 145 of the third wall 138R, the boss 150L is positioned at a front end portion of the first recess 145 of the third wall 138L, the right end portion of the coupling part 153 is positioned at the front end portion of the second recess 146 of the third wall 138R and the left end portion of the coupling part 153 is positioned at the front end portion of the second recess 146 of the third wall 138L.

As shown in FIGS. 5 and 6A, the interlocking part 133R is positioned at a right end portion of the handle unit 87. The interlocking part 133R has the first rod 161, which is an example of the fixing part, the second rod 162, a connection part 163, and an urging member 164.

The first rod 161 is positioned at a rear end portion of the interlocking part 133R. The first rod 161 extends in the left-right direction. The first rod 161 has a cylinder shape. An outer end portion in the left-right direction of the first rod 161 is notched so that it is inclined rearward as it faces inward in the left-right direction. The first rod 161 is inserted into the hole 142 of the first wall 136R and the hole 143 of the second wall 137R. The outer end portion in the left-right direction of the first rod 161 is positioned at an outermore side in the left-right direction than the first wall 136R. A front circumferential surface of the outer end portion in the left-right direction of the first rod 161 is a fixing surface 166. The fixing surface 166 extends in the left-right direction. In other words, the fixing surface 166 extends in a direction substantially perpendicular to the moving direction of the developing device 24. An inner end portion in the left-right direction of the first rod 161 is positioned between the second wall 137R and the third wall 138R.

The second rod 162 is positioned at a front end portion of the interlocking part 133R. The second rod 162 extends in the left-right direction. The second rod 162 has a substantial prism shape. The second rod 162 is inserted into the hole 147 of the third wall 138R and the hole 156 of the fourth wall 151R of the moveable handle 132. An outer end portion in the left-right direction of the second rod 162 is positioned between the second wall 137R and the third wall 138R. An inner end portion in the left-right direction of the second rod 162 is positioned at a more inner side in the left-right direction than the fourth wall 151R of the moveable handle 132. The second rod 162 has a boss 167.

The boss 167 is positioned at the inner end portion in the left-right direction of the second rod 162. The boss 167 extends in the upper-lower direction. The boss 167 has a cylinder shape. A size in the upper-lower direction of the boss 167 is greater than a size in the upper-lower direction of the hole 156 of the fourth wall 151R.

The connection part 163 is configured to connect the inner end portion in the left-right direction of the first rod 161 and the outer end portion in the left-right direction of the second rod 162. The connection part 163 has a plate shape. The connection part 163 is inclined outward in the left-right direction as it faces rearward.

The urging member 164 is positioned at the inner end portion in the left-right direction of the first rod 161. The urging member 164 is a coil spring extending in the left-right direction. An outer end portion in the left-right direction of the urging member 164 is fixed to the outer end portion in the left-right direction of the first rod 161. The inner end portion in the left-right direction of the urging member 164 is fixed to an outer surface in the left-right direction of the third wall 138R. The urging member 164 is configured to always urge the interlocking part 133R outward in the left-right direction.

In this way, the interlocking part 133R can move to a lock position (refer to FIG. 7) by the urging force of the urging member 164, at which a rear end portion of an outer side in the left-right direction of the connection part 163 is in contact with the second wall 137R and the outer end portion in the left-right direction of the first rod 161 is positioned at an outermore side in the left-right direction than the first wall 136R and move to a lock release position (refer to FIG. 8) against the urging force of the urging member 164, at which the rear end portion of the outer side in the left-right direction of the connection part 163 separates from the second wall 137R and the outer end portion in the left-right direction of the first rod 161 is located at a position at which it overlaps with the first wall 136R when projected in the upper-lower direction.

The interlocking part 133L is located at a left end portion of the handle unit 87. The interlocking part 133L has the same shape as the interlocking part 133R.

Figure 7:
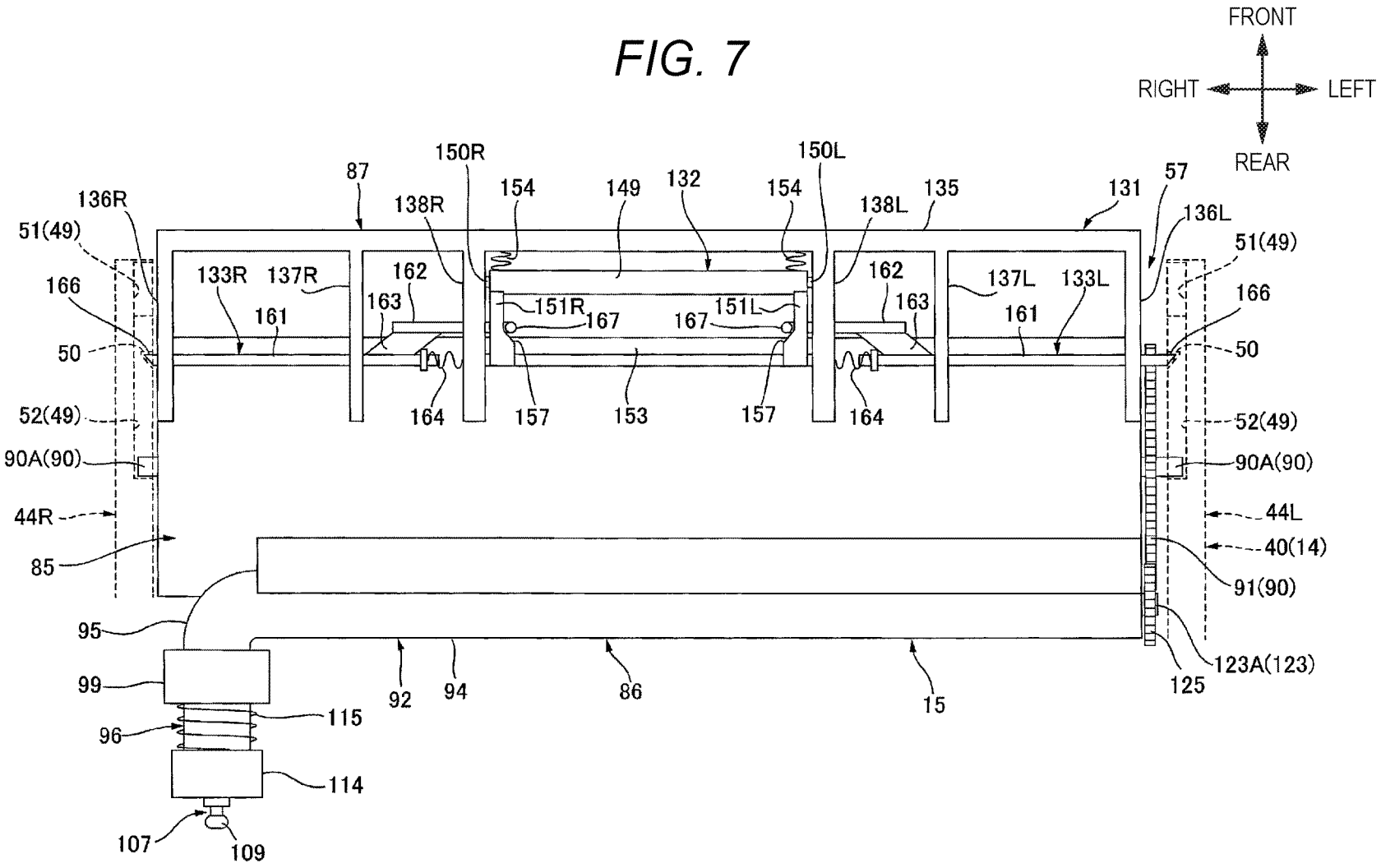
FIG. 7 depicts a process cartridge shown in FIG. 4A, illustrating a state where a moveable handle of the toner cartridge is located at a first position.
Figure 8:
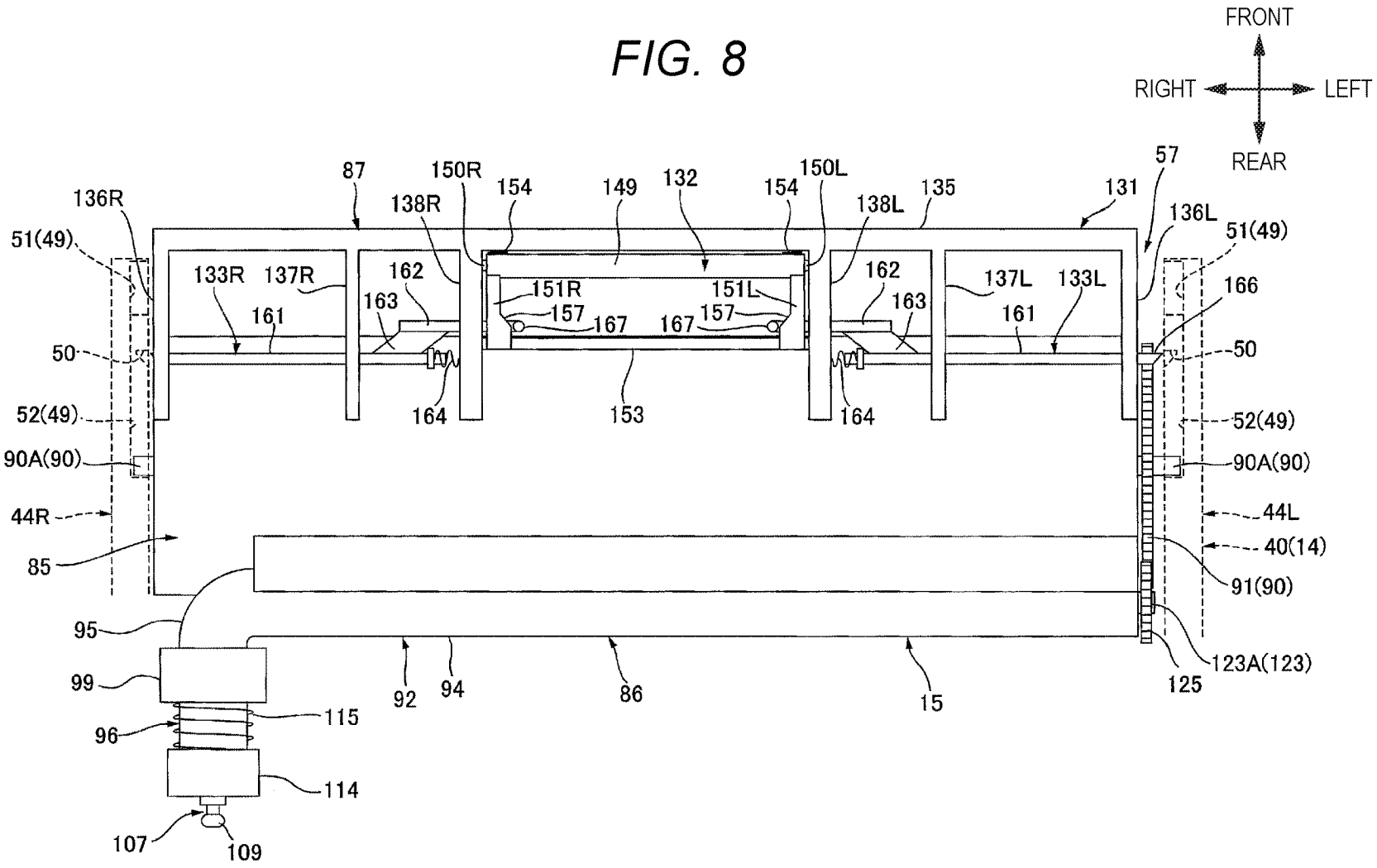
FIG. 8 depicts the process cartridge shown in FIG. 7, illustrating a state where the moveable handle of the toner cartridge is located at a second position.

Incidentally, when the interlocking part 133L is positioned at the lock position, the outer end portion in the left-right direction of the first rod 161 of the interlocking part 133L is positioned at an outermore side in the left-right direction than the agitator gear 91, as shown in FIG. 7. Also, when the interlocking part 133L is positioned at the lock release position, the outer end portion in the left-right direction of the first rod 161 of the interlocking part 133L overlaps with the agitator gear 91, as projected in the upper-lower direction, as shown in FIG. 8.

(2) Mounted State of Toner Cartridge

As shown in FIG. 4A, the toner cartridge 15 is positioned in front of the partition wall 47 at a state where it is mounted to the toner cartridge mounting part 57. In other words, the partition wall 47 is positioned between the toner cartridge 15 and the developing device 24.

At this time, the right end portion of the agitator shaft 90A is fitted to the rear end portion of the second recess 52 of the sidewall 44R of the drum unit 14, as shown in FIGS. 4A and 7. The left end portion of the agitator shaft 90A is fitted to the rear end portion of the second recess 52 of the sidewall 44L of the drum unit 14, as shown in FIG. 7.

Also, the first rod 161 of the interlocking part 133R is fitted to the fixing hole 50 of the sidewall 44R. The fixing surface 166 of the first rod 161 of the interlocking part 133R is in contact with an inner peripheral surface of the fixing hole 50. The first rod 161 of the interlocking part 133L is fitted to the fixing hole 50 of the sidewall 44L. The fixing surface 166 of the first rod 161 of the interlocking part 133L is in contact with an inner peripheral surface of the fixing hole 50.

Also, as shown in FIG. 4A, the conveyance unit 86 protrudes toward the rear of the partition wall 47 through the insertion hole 55 of the partition wall 47. The coupling tube 96 of the conveyance unit 86 is coupled to the receiving part 63 of the developing device 24.

The convex portion 107 of the coupling tube 96 is fitted to the concave portion 78 of the receiving part 63. The protrusion 109 of the convex portion 107 is positioned at the rear of the plate spring 82 of the concave portion 78. Thereby, the plate spring 82 restrains the coupling tube 96 from moving forward with respect to the receiving part 63.

Also, the second contact surface 110 of the coupling tube 96 is in contact with the first contact surface 81 of the receiving part 63. Thereby, the first contact surface 81 restrains the coupling tube 96 from moving rearward with respect to the receiving part 63.

Also, at this time, the shutter 114 is in contact with the cylinder part 76 of the receiving part 63 and is located at the opening position against the urging force of the urging member 115.

At a state where the coupling tube 96 is coupled to the developing device 24, the toner supply port 111 of the coupling tube 96 faces the communication port 80 of the developing device 24 and the toner receiving port 73.

4. Details of Apparatus Main Body

Figure 10:
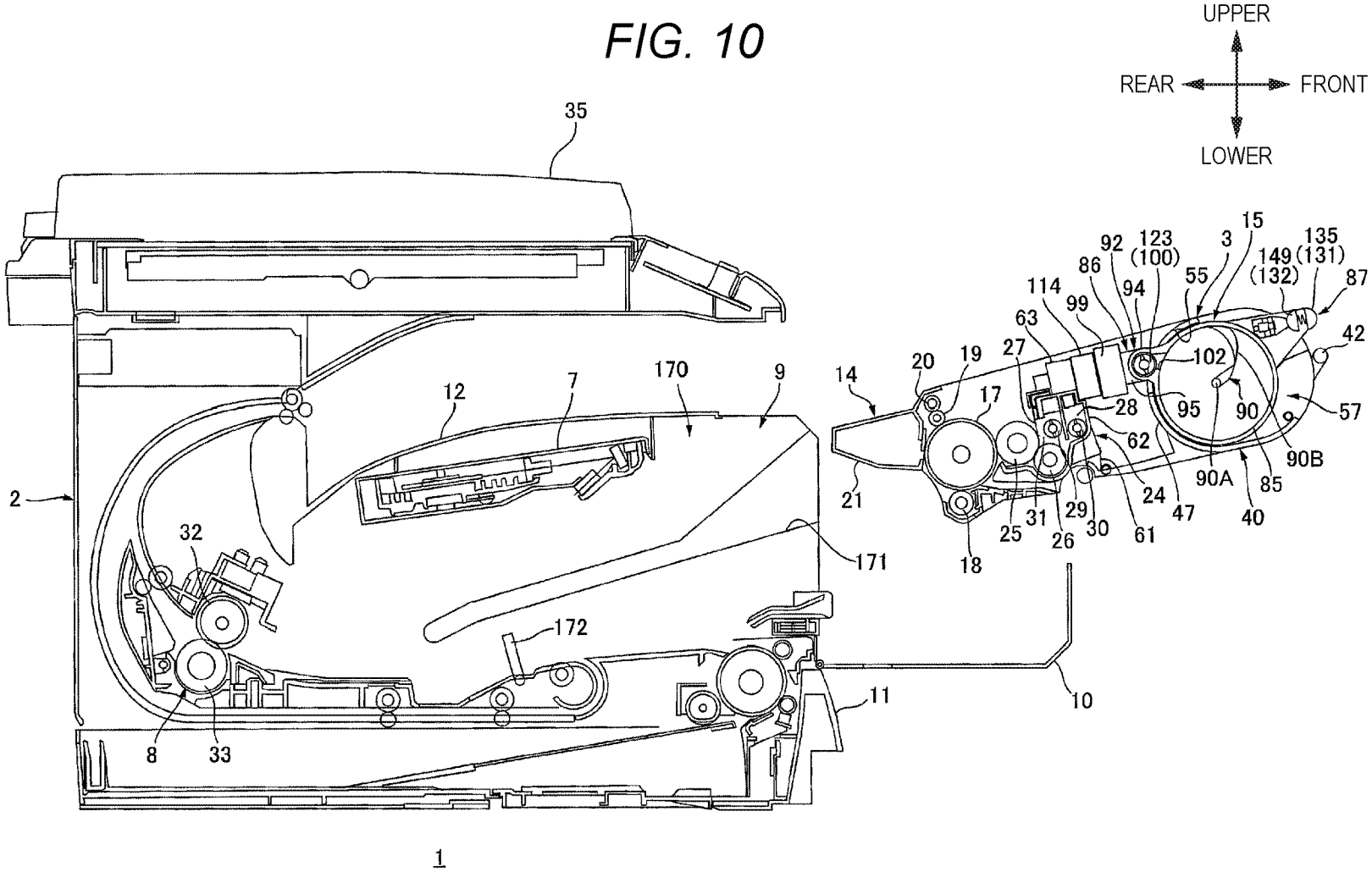
FIG. 10 illustrates mounting and removal of the process cartridge to and from the image forming apparatus.

As shown in FIG. 10, the apparatus main body 2 has a right sidewall 170 having a receiving recess 171, a left sidewall (not shown) having the receiving recess 171 and two separating members 172.

The sidewall 170 is positioned at a right end portion of the apparatus main body 2. The sidewall 170 extends in the upper-lower and front-rear directions. The sidewall 170 has a plate shape.

The receiving recess 171 is recessed outward in the left-right direction from an inner surface in the left-right direction of the sidewall 170. The receiving recess 171 extends in a rear-lower direction from the opening 9.

The sidewall (not shown) is positioned at a left end portion of the apparatus main body 2. The sidewall (not shown) has the receiving recess 171 on an inner surface in the left-right direction, like the sidewall 170.

The drum shaft 17B of the photosensitive drum 17 of the process cartridge 3 is received in the receiving recesses 171 of the sidewall 170 and the sidewall (not shown).

Thereby, the apparatus main body 2 supports the process cartridge 3.

The two separating members 172 are positioned in front of a rear-lower end portion of the receiving recess 171, as seen in the left-right direction. As shown in FIG. 3, the two separating members 172 are positioned at an interval in the left-right direction. As shown in FIGS. 2B and 4A, the separating member 172 extends in the upper-lower direction. The separating member 172 has a substantial prism shape. The separating member 172 is configured to be rotatable about a lower end portion of the separating member 172 serving as a support point. An upper end portion of the left separating member 172 faces a front end portion of the supply collar 26CL of the supply roller 26. Also, as shown in FIG. 3, an upper end portion of the right separating member 172 faces a front end portion of the supply collar 26CR.

5. Attaching and Detaching Operations of Toner Cartridge and Process Cartridge

The toner cartridge 15 can be attached and detached with respect to the drum unit 14 in any state of a state where the drum unit 14 is mounted to the apparatus main body 2 and a state where the drum unit 14 is removed from the apparatus main body 2.

In the below, attaching and detaching operations of the toner cartridge 15 with the drum unit 14 being mounted to the apparatus main body 2 are described.

(1) Removal of Toner Cartridge

Figure 9:
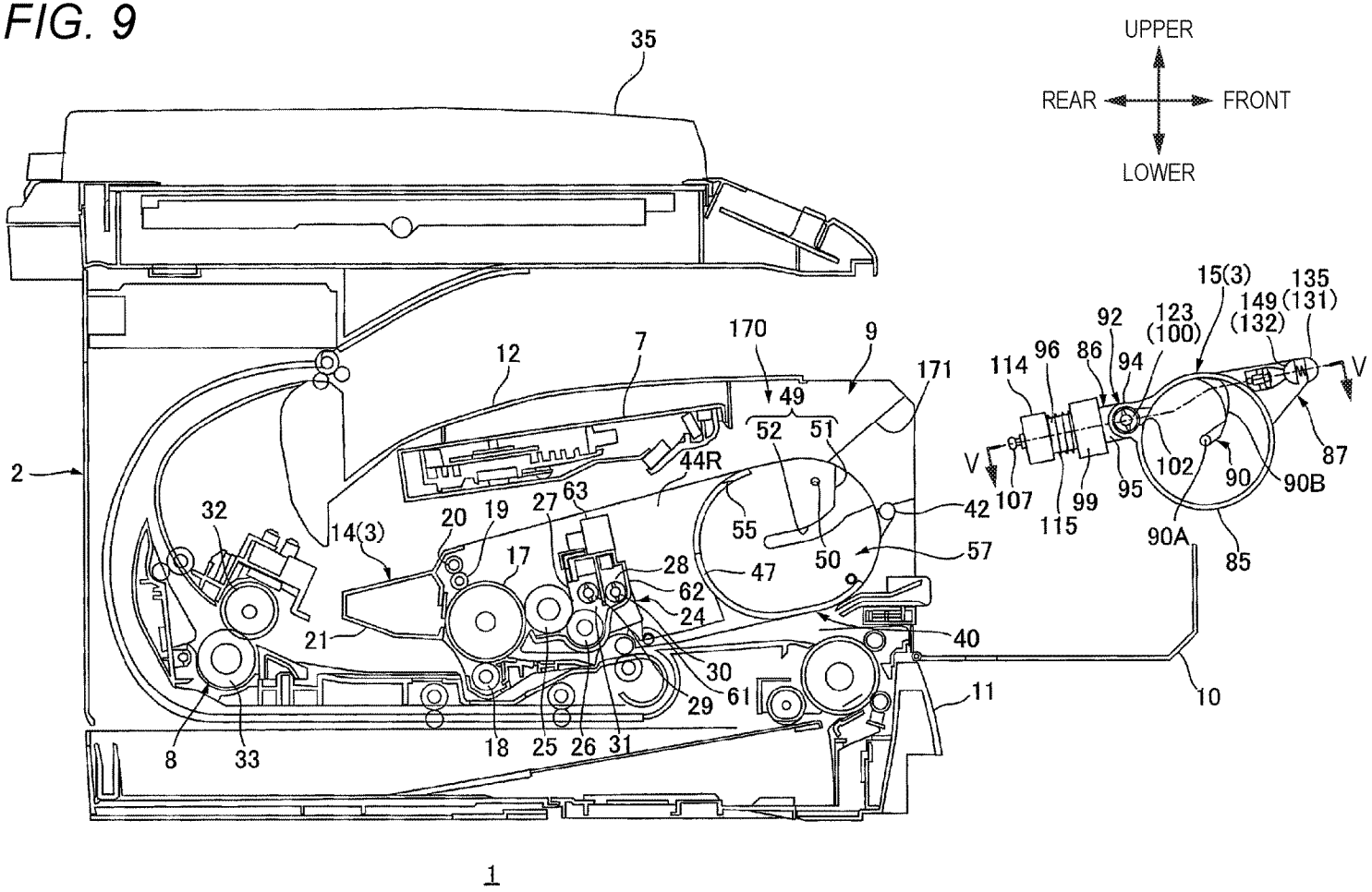
FIG. 9 illustrates mounting and removal of the toner cartridge to and from the drum cartridge.

When removing the toner cartridge 15 from the drum unit 14, an operator locates the front cover 10 of the apparatus main body 2 at the opening position, as shown in FIG. 9.

Then, the operator integrally grasps the first grip 135 of the fixed handle 131 of the handle unit 87 and the second grip 149 of the moveable handle 132.

At this time, as shown in FIGS. 7 and 8, the operator brings the second grip 149 of the moveable handle 132 close to the first grip 135 of the fixed handle 131 and moves the moveable handle 132 from the first position to the second position, against the urging forces of the urging members 154.

Then, the boss 167 of the interlocking part 133R is moved leftward to sit on the inclined part 157 of the fourth wall 151R. Also, the boss 167 of the interlocking part 133L is moved rightward to sit on the inclined part 157.

Thereby, the interlocking part 133R and the interlocking part 133L are moved from the lock position to the lock release position against the urging force of the urging member 164.

Then, the first rod 161 of the interlocking part 133R separates from the fixing hole 50 of the sidewall 44R. Also, the first rod 161 of the interlocking part 133L separates from the fixing hole 50 of the left sidewall 44L.

In this way, the contact of the fixing surface 166 of the first rod 161 with the inner peripheral surface of the fixing hole 50 is released.

Then, as shown in FIG. 9, the operator pulls the toner cartridge 15 in the front-upper direction from the drum unit 14.

Thereby, the toner cartridge 15 is removed from the drum unit 14.

Also, the coupling of the toner cartridge 15 to the developing device 24 is released, so that the shutter 114 is located at the closed position to close the toner supply port 111 by the urging force of the urging member 115, as shown in FIG. 6B.

(2) Mounting of Toner Cartridge

In order to mount the toner cartridge 15 to the drum unit 14, the operator locates the front cover 10 at the opening position, as shown in FIG. 9.

Then, the operator mounts the toner cartridge 15 to the toner cartridge mounting part 57 by enabling the agitator shaft 90A to follow the first recess 51 and second recess 52 of the guide part 49.

At this time, the operator inserts the conveyance unit 86 into the insertion hole 55.

Then, the operator couples the coupling tube 96 of the conveyance unit 86 to the receiving part 63. Specifically, as shown in FIG. 4, the operator inserts the convex portion 107 of the coupling tube 96 into the concave portion 78 of the receiving part 63.

Thereby, the protrusion 109 of the convex portion 107 surmounts the plate spring 82 of the concave portion 78 and is then positioned at the rear of the plate spring 82.

Also, the coupling tube 96 is coupled to the receiving part 63, so that the rear end portion of the shutter 114 is contacted to the front end portion of the cylinder part 76 of the receiving part 63. Thereby, the shutter 114 is located at the opening position.

Then, the operator locates the front cover 10 at the closed position.

Thereby, as shown in FIG. 1, the toner cartridge 15 is mounted to the drum unit 14.

6. Attaching and Detaching Operations of Process Cartridge (1) Removal of Process Cartridge When removing the process cartridge 3 from the apparatus main body 2, the operator locates the front cover 10 of the apparatus main body 2 at the opening position, as shown in FIG. 10.

Then, the operator grasps the drum handle 42 and pulls out the process cartridge 3 in the front-upper direction from the apparatus main body 2.

Thereby, the process cartridge 3 is moved along the receiving recess 171 and is removed from the apparatus main body 2.

(2) Mounting of Process Cartridge

When mounting the process cartridge 3 to the apparatus main body 2, the operator locates the front cover 10 at the opening position and then inserts the process cartridge 3 into the apparatus main body 2.

At this time, the operator mounts the process cartridge 3 so that the drum shaft 17B of the photosensitive drum 17 of the process cartridge 3 follows the receiving recess 171.

Then, the operator locates the front cover 10 at the closed position.

Thereby, the process cartridge 3 is mounted to the apparatus main body 2.

7. Image Forming Operation

As shown in FIG. 1, when the image forming apparatus 1 starts an image forming operation, the charging roller 19 uniformly charges the surface of the photosensitive drum 17. The scanner unit 7 emits the laser beam L to expose the surface of the photosensitive drum 17. Thereby, an electrostatic latent image based on image data is formed and carried on the surface of the photosensitive drum 17.

Also, as shown in FIGS. 5 and 6A, in the toner cartridge 15, the agitator 90 stirs the toner in the toner accommodation part 85 and the toner is conveyed to the first conveyance tube 94 through the communication port 102.

Then, the driving force is input to the conveyance gear 125, so that the auger screw 123 and the coil spring 122 are together rotated, thereby conveying the toner in the first conveyance tube 94 to the rear end portion of the coupling tube 96 through the second conveyance tube 95.

Then, as shown in FIGS. 2A and 4A, the toner is supplied to the toner accommodation part 28 through the toner supply port 111, the communication port 80 and the toner receiving port 73.

Then, as shown in FIG. 2A, the second screw 30 conveys the toner in the toner accommodation part 28 in the left-right direction. The toner in the toner accommodation part 28 is supplied to the developing part 31 through the openings provided at both end portions in the left-right direction of the partition wall 70.

The first screw 29 conveys the toner in the developing part 31 in the left-right direction. The toner in the developing part 31 is supplied to the supply roller 26.

The supply roller 26 supplies the toner in the developing part 31 to the developing roller 25. At this time, the toner is positively friction-charged between the developing roller 25 and the supply roller 26 and is carried on the developing roller 25. The layer thickness regulation blade 27 regulates a layer thickness carried on the developing roller 25 to a predetermined thickness.

The toner carried on the developing roller 25 is supplied to the electrostatic latent image on the surface of the photosensitive drum 17. Thereby, a toner image is carried on the surface of the photosensitive drum 17.

As shown in FIG. 1, sheets P are fed one by one to between the photosensitive drum 17 and the transfer roller 18 from the sheet feeding tray 11 at predetermined timing. The toner image on the surface of the photosensitive drum 17 is transferred to the sheet P when the sheet P passes between the photosensitive drum 17 and the transfer roller 18.

Then, the sheet P is heated and pressed when passing between the heating roller 32 and the pressing roller 33. Thereby, the toner image on the sheet P is heat-fixed on the sheet P.

Thereafter, the sheet P is stacked on the sheet discharging tray 12.

In the image forming operation, as shown in FIG. 4A, the developing device 24 is moved with respect to the photosensitive drum 17 by rotations of the photosensitive drum 17 and the developing roller 25. The developing device 24 is moved in the front-rear direction along the first long hole 59 and the second long hole 60.

At this time, the coupling tube 96 of the toner cartridge 15 is coupled to the receiving part 63, so that it is moved in the front-rear direction together with the developing device 24.

Then, the buffer member 98 of the toner cartridge 15 is compressed and deformed in the front-rear direction. For this reason, the coupling tube 96 of the toner cartridge 15 is moved with respect to the toner accommodation part 28 with the toner supply port 111 facing the toner receiving port 73 each other.

8. Contact/Separation Operations of Photosensitive Drum and Developing Roller

Figure 4B:
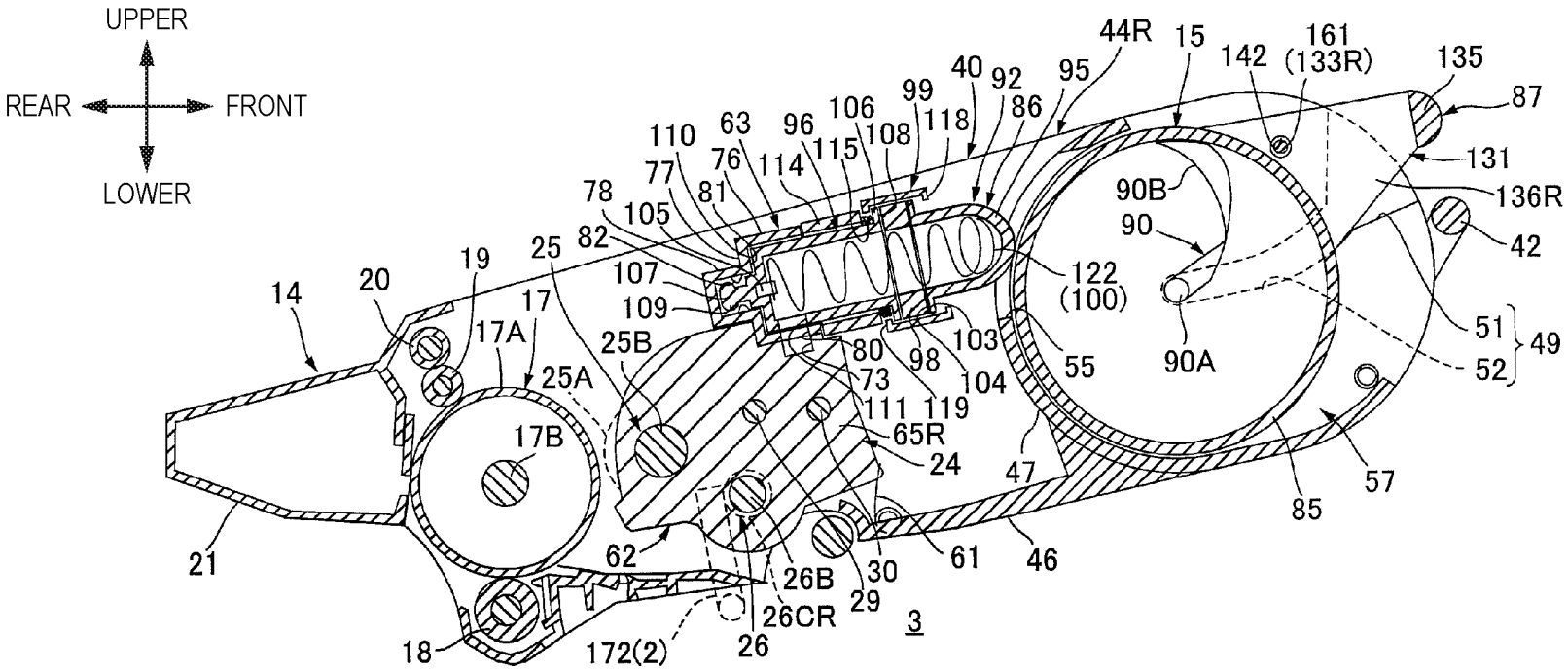
FIG. 4B depicts the process cartridge shown in FIG. 1, illustrating a state where the developing roller separates from the photosensitive drum.

As shown in FIGS. 4A and 4B, the separating member 172 is configured to rotate in a clockwise direction about the lower end portion serving as a support point upon a cleaning operation, a warm-up operation or the like, as seen from a left side.

Thereby, as shown in FIG. 4B, the separating members 172 press forward the supply collar 26CR and the supply collar 26CL of the supply roller 26. Then, the developing device 24 is moved forward along the first long hole 59 and the second long hole 60 against the urging forces of the springs 61. In this way, the developing device 24 is moved from a contact position at which the developing roller 25 is in contact with the photosensitive drum 17 to a separation position at which the developing roller 25 separates from the photosensitive drum 17.

Incidentally, when the developing roller 25 separates from the photosensitive drum 17, the coupling tube 96 is coupled to the receiving part 63, so that it is moved forward together with the developing device 24.

At this time, the buffer member 98 of the toner cartridge 15 is compressed and deformed in the front-rear direction. For this reason, the coupling tube 96 of the toner cartridge 15 is moved with respect to the toner accommodation part 28 with the toner supply port 111 facing the toner receiving port 73 each other.

9. Advantages (1) According to the image forming apparatus 1 and the toner cartridge 15, as shown in FIGS. 4A and 4B, the coupling tube 96 of the toner cartridge 15 is coupled to the developing device 24 and can move with respect to the toner accommodation part 28 with the toner supply port 111 and the toner receiving port 73 facing each other.

According to the above configuration, as the developing device 24 moves with respect to the photosensitive drum 17, the coupling tube 96 of the toner cartridge 15 moves.

For this reason, when the developing device 24 moves with respect to the photosensitive drum 17, the toner supply port 111 and the toner receiving port 73 do not deviate. As a result, it is possible to suppress toner leakage between the toner cartridge 15 and the developing device 24.

Also, when the developing device 24 moves with respect to the photosensitive drum 17, the coupling tube 96 of the toner cartridge 15 moves with respect to the toner accommodation part 85 of the toner cartridge 15. As a result, even when a toner capacity of the toner cartridge 15 is large, it is possible to stably swing the developing device 24 with respect to the photosensitive drum 17.

(2) According to the image forming apparatus 1, as shown in FIGS. 4A and 4B, it is possible to permit the coupling tube 96 to move with respect to the second conveyance tube 95 of the conveyance unit 86 by the deformation of the buffer member 98.

(3) According to the image forming apparatus 1, as shown in FIGS. 4A and 4B, it is possible to permit the conveyance unit 86 to move with respect to the second conveyance tube 95 in the front-rear direction by the buffer member 98.

(4) According to the image forming apparatus 1, as shown in FIGS. 4A and 4B, it is possible to securely suppress the toner leakage between the second conveyance tube 95 and the coupling tube 96 by the buffer member 98, which is a seal member.

(5) According to the image forming apparatus 1, as shown in FIGS. 4A and 4B, since the buffer member 98 is made of urethane foam, it is possible to permit the coupling tube 96 to move with respect to the second conveyance tube 95 and to suppress the toner leakage between the second conveyance tube 95 and the coupling tube 96.

(6) According to the image forming apparatus 1, as shown in FIGS. 4A and 4B, the buffer member 98 adheres to the first adhesion surface 104 of the first flange part 103, so that it is possible to deform the buffer member 98 with being in contact with the first flange part 103 of the second conveyance tube 95 without a gap.

As a result, it is possible to suppress the toner leakage between the second conveyance tube 95 and the buffer member 98.

(7) According to the image forming apparatus 1, as shown in FIGS. 4A and 4B, the first adhesion surface 104 extends in the direction substantially perpendicular to the moving direction of the coupling tube 96 with respect to the toner accommodation part 85.

For this reason, it is possible to suppress the buffer member 98 from separating from the conveyance tube 92 due to the movement of the developing device 24.

As a result, it is possible to securely suppress the toner leakage between the conveyance tube 92 and the buffer member 98.

(8) According to the image forming apparatus 1, as shown in FIGS. 4A and 4B, the buffer member 98 adheres to the second adhesion surface 108 of the second flange part 106, so that it is possible to deform the buffer member 98 with being in contact with the coupling tube 96 without a gap.

For this reason, it is possible to suppress the toner leakage between the coupling tube 96 and the buffer member 98.

(9) According to the image forming apparatus 1, as shown in FIGS. 4A and 4B, the second adhesion surface 108 extends in the direction substantially perpendicular to the moving direction of the coupling tube 96.

For this reason, it is possible to suppress the buffer member 98 from separating from the conveyance tube 92 due to the movement of the developing device 24.

As a result, it is possible to securely suppress the toner leakage between the conveyance tube 92 and the buffer member 98.

(10) According to the image forming apparatus 1, as shown in FIGS. 4A and 4B, since the coupling tube 96 has the substantial cylinder shape extending in the front-rear direction, it is possible to convey the toner in the front-rear direction with the simple configuration.

(11) According to the image forming apparatus 1, as shown in FIGS. 4A and 5, the coil spring 122 is positioned over the interior of the second conveyance tube 95 and the interior of the coupling tube 96, so that it is possible to securely convey the toner to the coupling tube 96.

(12) According to the image forming apparatus 1, as shown in FIGS. 4A and 4B, when the coupling tube 96 moves, it is possible to elastically deform the coil spring 122.

For this reason, it is possible to convey the toner in the coupling tube 96 by the coil spring 122 while smoothly moving the coupling tube 96.

(13) According to the image forming apparatus 1, as shown in FIGS. 5 and 6A, it is possible to convey rightward the toner in the first conveyance tube 94 by the auger screw 123 and to supply the toner to the coupling tube 96 through the second conveyance tube 95.

As a result, it is possible to convey the toner in the toner accommodation part 85 to the developing device 24 by the auger screw 123 and the coil spring 122.

(14) According to the image forming apparatus 1, as shown in FIG. 5, the front end portion 122B of the coil spring 122 and the right end portion 123B of the auger screw 123 are coupled to each other, so that it is possible to interlock the coil spring 122 and the auger screw 123.

(15) According to the image forming apparatus 1, as shown in FIG. 5, the conveyance gear 125 is positioned at the left of the first conveyance tube 94 and the coupling tube 96 is positioned at the right end portion of the conveyance unit 86. That is, the conveyance gear 125 and the coupling tube 96 are positioned with being spaced in the left-right direction.

For this reason, it is possible to suppress vibrations, which result from the driving of the conveyance gear 125, from being transmitted to the coupling tube 96.

As a result, it is possible to stably convey the toner.

(16) According to the image forming apparatus 1, as shown in FIGS. 4A and 4B, the second contact surface 110 of the coupling tube 96 is contacted to the first contact surface 81 of the receiving part 63 of the developing device 24, so that it is possible to enable the coupling tube 96 to follow the movement of the developing device 24.

(17) According to the image forming apparatus 1, as shown in FIGS. 4A and 4B, the first contact surface 81 of the receiving part 63 extends in the direction substantially perpendicular to the moving direction of the coupling tube 96.

For this reason, it is possible to stably bring the coupling tube 96 into contact with the first contact surface 81 of the receiving part 63.

(18) According to the image forming apparatus 1, as shown in FIGS. 4A and 4B, the second contact surface 110 of the coupling tube 96 extends in the direction substantially perpendicular to the moving direction of the coupling tube 96.

For this reason, it is possible to stably bring the receiving part 63 into contact with the second contact surface 110 of the coupling tube 96.

(19) According to the image forming apparatus 1, as shown in FIGS. 4A and 4B, the convex portion 107 is engaged with the concave portion 78 to make the protrusion 109 and the plate spring 82 face each other, so that it is possible to regulate the movement of the coupling tube 96 with respect to the receiving part 63.

As a result, it is possible to keep a state where the toner supply port 111 and the toner receiving port 73 and communication port 80 are securely made to face each other.

(20) According to the image forming apparatus 1, as shown in FIGS. 4A and 4B, it is possible to mount the toner cartridge 15 to the predetermined toner cartridge mounting part 57.

(21) According to the image forming apparatus 1, as shown in FIG. 7, it is possible to fix the toner cartridge 15 to the toner cartridge mounting part 57 by fitting the first rod 161 of the handle unit 87 of the toner cartridge 15 to the fixing hole 50 of the toner cartridge mounting part 57.

(22) According to the image forming apparatus 1, as shown in FIG. 7, since the fixing surface 166 of the first rod 161 extends in the left-right direction, it is possible to suppress the toner cartridge 15 from moving forward by bringing the fixing surface 166 into contact with the inner peripheral surface of the fixing hole 50.

For this reason, even when the toner cartridge 15 is pushed from the developing device 24, it is possible to suppress the toner cartridge from being removed from the toner cartridge mounting part 57.

(23) According to the image forming apparatus 1, as shown in FIGS. 4A and 4B, the partition wall 47 of the drum unit 14 has the insertion hole 55 in which the coupling tube 96 can be inserted.

For this reason, it is possible to mount the toner cartridge 15 to the toner cartridge mounting part 57 and to securely couple the coupling tube 96 to the developing device 24 through the insertion hole 55.

(24) According to the image forming apparatus 1, as shown in FIGS. 4A and 4B, since the second recess 52 of the guide part 49 configured to guide the mounting and removal of the toner cartridge 15 has the linear part extending in the front-rear direction, it is possible to mount the toner cartridge 15 to the toner cartridge mounting part 57 along the front-rear direction.

For this reason, when mounting the toner cartridge 15, it is possible to smoothly couple the coupling tube 96 to the developing device 24 along the front-rear direction.

(25) According to the image forming apparatus 1, as shown in FIGS. 4A and 4B, the arrangement direction of the photosensitive drum 17 and the developing roller 25 and the moving direction of the coupling tube 96 are substantially the same.

For this reason, it is possible to move the coupling tube 96 with respect to the second conveyance tube 95 in the arrangement direction of the photosensitive drum 17 and the developing roller 25.

As a result, when the developing device 24 moves with respect to the photosensitive drum 17 in the arrangement direction of the photosensitive drum 17 and the developing roller 25, it is possible to move the coupling tube 96 with respect to the second conveyance tube 95 while keeping the state where the toner supply port 111 and the toner receiving port 73 and communication port 80 face each other.

(26) According to the image forming apparatus 1, as shown in FIGS. 4A and 4B, since the springs 61 are configured to press rearward the developing device 24, it is possible to move the coupling tube 96 with respect to the second conveyance tube 95 in conformity to the pressing of the springs 61.

For this reason, it is possible to stably bring the developing roller 25 into contact with the photosensitive drum 17.

(27) According to the image forming apparatus 1, as shown in FIGS. 2A and 2B, it is possible to guide the developing device 24 by the first long hole 59 and the second long hole 60 extending in the front-rear direction.

Since the springs 61 are configured to press rearward the developing device 24, it is possible to securely move the developing device 24 in the front-rear direction by the first long hole 59 and the second long hole 60.

(28) As shown in FIGS. 2A and 2B, the image forming apparatus 1 has the separating members 172 configured to move the developing device 24 from the contact position to the separation position along the front-rear direction.

Even when separating the developing roller 25 from the photosensitive drum 17 by the separating members 172, it is possible to suppress the toner leakage between the toner cartridge 15 and the developing device 24 while keeping the state where the toner supply port 111 and the toner receiving port 73 and communication port 80 face each other.

10. Second Illustrative Embodiment

In the below, a second illustrative embodiment of the image forming apparatus of the disclosure is described with reference to FIG. 11A. Meanwhile, in the second illustrative embodiment, the same members as the first illustrative embodiment are denoted with the same reference numerals and the descriptions thereof are omitted.

In the first illustrative embodiment, as shown in FIG. 4A, the conveyance unit 86 has the buffer member 98 made of urethane foam.

Figure 11A:
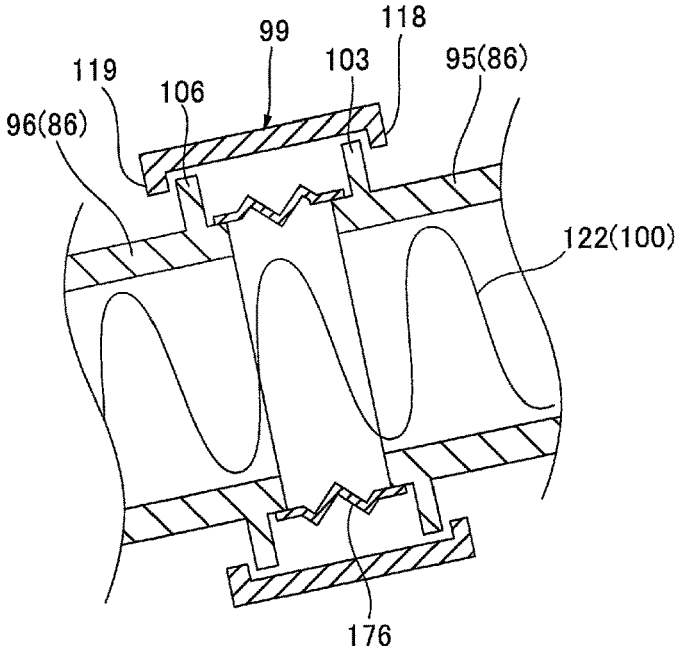
FIG. 11A is an enlarged view of main parts of the toner cartridge in accordance with a second illustrative embodiment of the image forming apparatus of the disclosure.

In contrast, according to the second illustrative embodiment, as shown in FIG. 11A, a bellows tube 176 may be disposed instead of the buffer member 98 made of urethane foam.

The bellows tube 176 extends in the front-rear direction. The bellows tube 176 is a tube that can expand and contract in the front-rear direction.

Also in the second illustrative embodiment, it is possible to achieve the same operational effects as the first illustrative embodiment.

11. Third Illustrative Embodiment

In the below, a third illustrative embodiment of the image forming apparatus of the disclosure is described with reference to FIG. 11B. Meanwhile, in the third illustrative embodiment, the same members as the first illustrative embodiment are denoted with the same reference numerals and the descriptions thereof are omitted.

In the first illustrative embodiment, as shown in FIG. 4A, the conveyance unit 86 has the buffer member 98 made of urethane foam.

Figure 11B:
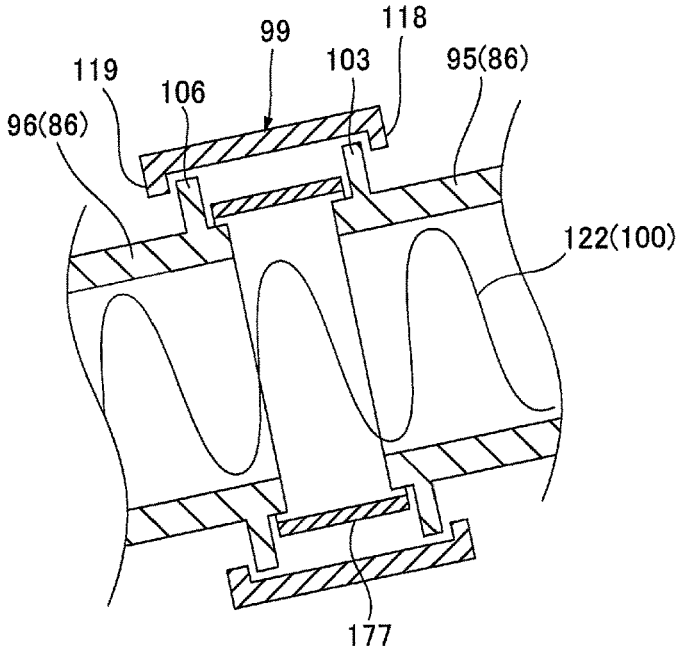
FIG. 11B is an enlarged view of main parts of the toner cartridge in accordance with a third illustrative embodiment of the image forming apparatus of the disclosure.

In contrast, according to the third illustrative embodiment, as shown in FIG. 11B, a soft tube 177 may be disposed instead of the buffer member 98 made of urethane foam.

The soft tube 177 extends in the front-rear direction. The soft tube 177 has a substantial cylinder shape. The soft tube 177 is a deformable tube.

Also in the third illustrative embodiment, it is possible to achieve the same operational effects as the first illustrative embodiment.

12. Modified Embodiments

The disclosure is not limited to the above illustrative embodiments. For example, in the above illustrative embodiments, the receiving part 63 of the developing device 24 has the cylinder part 76 having the communication port 80 and the closed part 77. However, the receiving part 63 may be configured to have only the closed part 77 without the cylinder part 76 having the communication port 80. In this case, the coupling tube 96 of the toner cartridge 15 is coupled to the closed part 77 of the receiving part 63, so that the toner supply port 111 and the toner receiving port 73 face each other.

Also, in the above illustrative embodiments, the drum unit 14 is configured to be mounted and removed to and from the apparatus main body 2. However, the drum unit may be configured so that it cannot be mounted and removed to and from the apparatus main body 2.

Also, in the above illustrative embodiments, the developing device 24 is configured so that it cannot be mounted and removed to and from the drum unit 14. However, the developing device 24 may be configured to be mounted and removed to and from the drum unit 14.

Also, the developing frame 62 and the receiving part 63 may be integrally configured.

Also, the springs 61 are not limited to two springs, and one or three or more springs may also be provided.

Also, the separating members 172 are not limited to two members, and one separating member may be provided.

What is claimed is:

1. An image forming apparatus comprising:

a photosensitive drum extending in an axis direction;

a developing device including a developing roller extending in the axis direction and a developing frame having a toner receiving port, the developing device movable with respect to the photosensitive drum in an arrangement direction of the photosensitive drum and the developing roller; and a toner cartridge including:

a coupling tube being configured to be coupled to the developing device, the coupling tube extending in the arrangement direction, the coupling tube having a toner supply port, the toner supply port being configured to face the toner receiving port with the coupling tube being coupled to the developing device;

a conveyance tube being configured to convey the toner to the coupling tube, the conveyance tube extending in the axis direction;

a first conveyance member extending in the arrangement direction, at least a part of the first conveyance member being positioned in the coupling tube; and a second conveyance member extending in the axis direction, the second conveyance member being positioned in the conveyance tube.

2. The image forming apparatus according to claim 1, wherein the first conveyance member is a coil spring.

3. The image forming apparatus according to claim 1, wherein the second conveyance member is an auger screw.

4. The image forming apparatus according to claim 1, wherein the first conveyance member includes:

a first end portion supported by the coupling tube; and a second end portion opposite to the first end portion in the arrangement direction, wherein the second conveyance member includes:

a third end portion supported by the conveyance tube; and a fourth end portion opposite to the third end portion in the axis direction, and wherein the second end portion of the first conveyance member and the fourth end portion of the second conveyance member are coupled.

5. The image forming apparatus according to claim 1, wherein the toner cartridge includes a toner accommodating part, wherein the coupling tube is movable with respect to the toner accommodating part in a state where the coupling tube is coupled to the developing device.

6. The image forming apparatus according to claim 1, wherein the coupling tube has a cylinder shape extending in the arrangement direction.

7. The image forming apparatus according to claim 1, wherein the toner cartridge includes a gear configured to rotate the second conveyance member, and wherein the coupling tube is positioned at an end portion of the toner cartridge that is opposite to the gear in the axis direction.

8. The image forming apparatus according to claim 1, wherein the toner cartridge includes:

a shutter configured to move between an opening position and a closed position, the opening position being a position at which the toner supply port is opened with the coupling tube being coupled to the developing device, the closed position being a position at which the toner supply port is closed with a coupling of the coupling tube to the developing device being released.

9. The image forming apparatus according to claim 1, wherein the toner cartridge includes:

a buffer member positioned between the conveyance tube and the coupling tube, the buffer member being configured to be deformable in a moving direction of the coupling tube.

10. The image forming apparatus according to claim 9, wherein the buffer member is configured to seal between the conveyance tube and the coupling tube.

11. The image forming apparatus according to claim 9, wherein the buffer member is made of urethane foam.

12. The image forming apparatus according to claim 9, wherein the conveyance tube has an adhesion surface which the buffer member is to adhere to, the adhesion surface extending in a direction perpendicular to the arrangement direction.

13. The image forming apparatus according to claim 1, further comprising:

a frame configured to receive the toner cartridge, wherein the frame includes a partition wall positioned between the developing device and the toner cartridge, and wherein the partition wall includes an insertion hole, into which the coupling tube is inserted.

14. The image forming apparatus according to claim 13, wherein the frame includes a first guide extending in the arrangement direction, the first guide configured to guide the toner cartridge.

15. The image forming apparatus according to claim 14, wherein the frame includes a second guide extending in the arrangement direction, the second guide configured to guide the developing device.

16. The image forming apparatus according to claim 1, further comprising:

a spring configured to press the developing frame toward the photosensitive drum, the spring being configured to press the developing device in the arrangement direction.

17. The image forming apparatus according to claim 1, further comprising:

a separating member configured to move the developing device from a contact position to a separation position, the contact position being a position at which the developing roller is in contact with the photosensitive drum, the separation position being a position at which the developing roller separates from the photosensitive drum, wherein when moving the developing frame from the contact position to the separation position, the separating member moves the developing device in the arrangement direction.

18. A toner cartridge configured to be mounted to and removed from an image forming apparatus, the image forming apparatus comprising a photosensitive drum extending in an axis direction and a developing roller extending in the axis direction, the toner cartridge comprising:

a first conveyance member extending in an arrangement direction of the photosensitive drum and the developing roller;

a second conveyance member extending in the axis direction;

a coupling tube configured to be coupled to a developing device of the image forming apparatus, the coupling tube extending in the arrangement direction; and a conveyance tube configured to convey toner to the coupling tube, the conveyance tube extending in the axis direction.

19. The toner cartridge according to claim 18, wherein the developing roller is part of a developing device having a toner receiving port, wherein the coupling tube has a toner supply port, the toner supply port being configured to face the toner receiving port with the coupling tube being coupled to the developing device, wherein at least a part of the first conveyance member is positioned in the coupling tube, and wherein the second conveyance member is positioned in the conveyance tube.

* * * * *